US007160659B2

(12) United States Patent
Uesugi et al.

(10) Patent No.: US 7,160,659 B2
(45) Date of Patent: Jan. 9, 2007

(54) ELECTROPHOTOGRAPHIC APPARATUS AND PROCESS CARTRIDGE

(75) Inventors: Hirotoshi Uesugi, Numazu (JP); Akira Yoshida, Yokohama (JP); Kazushige Nakamura, Yokohama (JP); Masataka Kawahara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/109,756

(22) Filed: Apr. 20, 2005

(65) Prior Publication Data

US 2005/0185987 A1 Aug. 25, 2005

Related U.S. Application Data

(63) Continuation of application No. PCT/JP04/15740, filed on Oct. 22, 2004.

(30) Foreign Application Priority Data

Oct. 23, 2003 (JP) ..... 2003-363494

(51) Int. Cl.
*G03G 15/04* (2006.01)

(52) U.S. Cl. ..... 430/66; 399/159

(58) Field of Classification Search ..... 430/66; 399/159

See application file for complete search history.

(56) References Cited

U.S. PATENT DOCUMENTS 6,203,954 B1 3/2001 Anayama ..... 430/67
6,395,441 B1 5/2002 Uesugi et al. ..... 430/66
6,942,952 B1 * 9/2005 Uesugi et al. ..... 430/66
2002/0068231 A1 6/2002 Uesugi et al. ..... 430/66
2003/0118931 A1 * 6/2003 Yano et al. ..... 430/108.22

FOREIGN PATENT DOCUMENTS

JP 2000-81715 A 3/2000
JP 2001-249481 A 9/2001
JP 2003-015327 A 1/2003
JP 2003-107791 A 4/2003

* cited by examiner

*Primary Examiner*—John L Goodrow
(74) *Attorney, Agent, or Firm*—Fitzpatrick, Cella, Harper & Scinto

(57) ABSTRACT

An electrophotographic apparatus adopts a contact development system as a development system, which hardly causes toner fusion, and which hardly causes fogging in an output image; and a process cartridge is detachably attached to a main body of the electrophotographic apparatus. Specifically, provided are: an electrophotographic apparatus equipped with an electrophotographic photoreceptor having a surface layer containing a diorganopolysiloxane having a specific repeating structural unit; and a process cartridge that is detachably attached to a main body of the electrophotographic apparatus.

7 Claims, 2 Drawing Sheets

ELECTROPHOTOGRAPHIC APPARATUS AND PROCESS CARTRIDGE

TECHNICAL FIELD

The present invention relates to an electrophotographic apparatus and a process cartridge that is detachably attached to a main body of the electrophotographic apparatus.

BACKGROUND ART

An image forming method according to an electrophotographic system includes: forming an electrostatic latent image on the surface of an electrophotographic photoreceptor by means of charging (primary charging) and exposure (image exposure); developing the electrostatic latent image with toner; transferring the resultant developed image (toner image) onto a transfer material such as paper; and fixing the transferred image to obtain an image.

Systems for developing an electrostatic latent image are roughly classified into: a contact development system in which a developer layer carried on a developer carrier (such as a developing roller or a developing sleeve) is brought into contact with the surface of an electrophotographic photoreceptor to perform development; and a jumping development system in which a developer carried on a developer carrier is allowed to fly to the surface of an electrophotographic photoreceptor to perform development.

The contact development system has an advantage in that the structure of a developing device can be simplified because a mechanism for allowing a developer to fly is not needed. However, a developer layer is pressed against the surface of an electrophotographic photoreceptor, so there arises a disadvantage in that toner in the developer is apt to fuse to the surface of the electrophotographic photoreceptor (hereinafter, also referred to as "toner fusion").

Therefore, an electrophotographic photoreceptor to be combined with contact development must have a surface with high releasability and hardly cause toner fusion.

In recent years, an organic electrophotographic photoreceptor using an organic photoconductive substance has been used as an electrophotographic photoreceptor because of its advantages, such as freedom from pollution, high productivity, and ease of material design Examples of a method of increasing the releasability of the surface of an electrophotographic photoreceptor, especially an organic electrophotographic photoreceptor include a method involving incorporating a releasing agent such as silicone oil or a fluorine atom-containing resin particle into the surface layer (outermost layer) of the electrophotographic photoreceptor.

However, it is difficult to allow silicone oil to be uniformly present in the surface layer. In addition, silicone oil is a material that tends to migrate to the surface of the surface layer. Therefore, there arises a disadvantage in that, even if desired releasability is obtained at an initial stage, the releasing effect disappears when the surface of the surface layer is worn out through repeated use.

In contrast, a fluorine atom-containing resin particle can be allowed to be uniformly present in the surface layer by means of a dispersing agent (see JP-A 2000-081715, JP-A 2001-249481, or the like). In addition, the particle has a higher releasing effect than that of silicone oil.

DISCLOSURE OF THE INVENTION

Problems to be Solved by the Invention

However, when an electrophotographic photoreceptor containing a fluorine atom-containing resin particle in its surface layer is used as an electrophotographic photoreceptor to be combined with contact development, fogging may occur in an output image. This is probably because of the following reason. The chargeability of the fluorine atom-containing resin particle in the surface layer of the electrophotographic photoreceptor is extremely negative as compared to the chargeability of a material generally used for toner. Thus, when the fluorine atom-containing resin particle present in the surface of the electrophotographic photoreceptor and toner in a developer layer carried on a developer carrier contact each other, the charge of toner in the developer layer is unbalanced. As a result, a larger amount of toner than is necessary adheres to the surface of the electrophotographic photoreceptor.

An object of the present invention is to provide: an electrophotographic apparatus which adopts a contact development system, which hardly causes toner fusion, and which hardly causes fogging in an output image; and a process cartridge that is detachably attached to a main body of the electrophotographic apparatus.

Means for Solving the Problems

According to one aspect of the present invention, there is provided an electrophotographic apparatus, including:

1) an electrophotographic photoreceptor having a support and a photosensitive layer placed on the support;

2) charging means for charging the surface of the electrophotographic photoreceptor;

3) exposing means for irradiating the surface of the electrophotographic photoreceptor charged by the charging means with exposure light to form an electrostatic latent image on the surface of the electrophotographic photoreceptor;

4) contact development means, which has a developer and a developer carrier for carrying a developer layer composed of at least the developer, for forming a developed image on the surface of the electrophotographic photoreceptor by bringing the developer layer carried on the developer carrier into contact with the surface of the electrophotographic photoreceptor to develop the electrostatic latent image; and 5) transferring means for transferring the developed image on the surface of the electrophotographic photoreceptor formed by the contact development means onto a transfer material, the electrophotographic apparatus being characterized in that a surface layer of the electrophotographic photoreceptor contains a diorganopolysiloxane having a repeating structural unit a represented by the following formula (11) and a repeating structural unit β represented by the following formula (12).

(11)

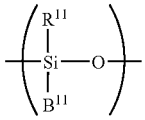

(12)

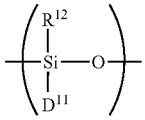

In the formulae (11) and (12), $R^{11}$ and $R^{12}$ each independently represent a substituted or unsubstituted monovalent hydrocarbon group. $B^{11}$ represents a monovalent organic group having a perfluoroalkyl group. $D^{11}$ represents a monovalent organic group having a substituted or unsubstituted polystyrene chain with a polymerization degree of 3 or more, a monovalent organic group having a substituted or unsubstituted alkyleneoxy group, a monovalent organic group having a substituted or unsubstituted siloxane chain, or a monovalent organic group having 12 or more carbon atoms.

According to another aspect of the present invention, there is provided a process cartridge, including:

1) an electrophotographic photoreceptor having a support and a photosensitive layer placed on the support; and 2) contact development means, which has a developer and a developer carrier for carrying a developer layer composed of at least the developer, for forming a developed image on the surface of the electrophotographic photoreceptor by bringing the developer layer carried on the developer carrier into contact with the surface of the electrophotographic photoreceptor to develop an electrostatic latent image formed on the surface of the electrophotographic photoreceptor, the process cartridge integrally supporting the electrophotographic photoreceptor and the contact development means, the process cartridge being detachably attached to a main body of the electrophotographic photoreceptor, the process cartridge being characterized in that a surface layer of the electrophotographic photoreceptor contains a diorganopolysiloxane having a repeating structural unit a represented by the following formula (11) and a repeating structural unit β represented by the following formula (12).

(11)

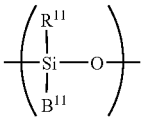

(12)

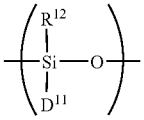

In the formulae (11) and (12), $R^{11}$ and $R^{12}$ each independently represent a substituted or unsubstituted monovalent hydrocarbon group. $B^{11}$ represents a monovalent organic group having a perfluoroalkyl group. $D^{11}$ represents a monovalent organic group having a substituted or unsubstituted polystyrene chain with a polymerization degree of 3 or more, a monovalent organic group having a substituted or unsubstituted alkyleneoxy group, a monovalent organic group having a substituted or unsubstituted siloxane chain, or a monovalent organic group having 12 or more carbon atoms.

Effect of the Invention

According to the present invention, there can be provided: an electrophotographic apparatus which adopts a contact development system, which hardly causes toner fusion, and which hardly causes fogging in an output image; and a process cartridge that is detachably attached to a main body of the electrophotographic apparatus.

BEST MODE FOR CARRYING OUT THE INVENTION

Figure 1:
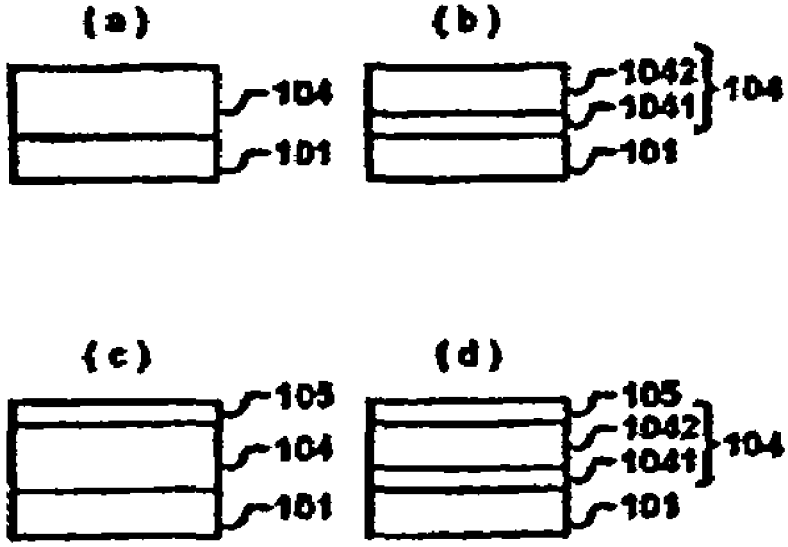
FIG. 1 is a drawing showing an example of a layer configuration of an electrophotographic photoreceptor used in the present invention.

Hereinafter, the present invention will be described in detail.

First, an electrophotographic photoreceptor to be used in each of an electrophotographic apparatus and process cartridge of the present invention will be described.

The electrophotographic photoreceptor to be used in each of the electrophotographic apparatus and process cartridge of the present invention (hereinafter, it may also be referred to as "electrophotographic photoreceptor of the present invention") contains, as a releasing agent, a diorganopolysiloxane having a repeating structural unit α represented by the formula (11) and a repeating structural unit β represented by the formula (12) (hereinafter, it may also be referred to as "diorganopolysiloxane of the present invention") in its surface layer. In the diorganopolysiloxane of the present invention, the repeating structural units α and β, which may be arranged at random or with regularity, are preferably arranged at random.

Unlike silicone oil, which is a conventional releasing agent, the diorganopolysiloxane of the present invention is free from a disadvantage of migrating to the surface of the surface layer. Therefore, even in a system adopting contact development in which toner fusion is apt to occur, toner fusion can be suppressed from an initial stage to a stage after repeated use. In addition, unlike a fluorine atom-containing resin particle, which is a conventional releasing agent, the charge of toner in a developer layer carried on a carrier developer carrier is not unbalanced. Therefore, the occurrence of fogging in an output image can be suppressed.

The diorganopolysiloxane of the present invention may be used in combination with another releasing agent in the surface layer of the electrophotographic photoreceptor of the present invention. However, it is preferable not to use a fluorine atom-containing resin particle because the particle may make the charge of toner in the developer layer unbalanced as described above. In other words, the surface layer of the electrophotographic photoreceptor of the present invention preferably contains no fluorine-atom containing resin particle.

The diorganopolysiloxane of the present invention may further have a repeating structural unit γ represented by the following formula (13).

(13)

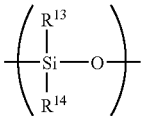

In the formula (13), $R^{13}$ and $R^{14}$ each independently represent a substituted or unsubstituted monovalent hydrocarbon group.

Examples of a terminal group of the diorganopolysiloxane of the present invention include a terminal group I having a structure represented by the following formula (14) and a terminal group II having a structure represented by the following formula (15).

(14)

$$E^{11}—$$

(15)

$$—\underset{R^{16}}{\overset{R^{15}}{Si}}—E^{12}$$

In the formulae (14) and (15), $R^{15}$ and $R^{16}$ each independently represent a substituted or unsubstituted monovalent hydrocarbon group. $E^{11}$ and $E^{12}$ each independently represent a monovalent group selected from the group consisting of a substituted or unsubstituted monovalent hydrocarbon group, a monovalent organic group having a perfluoroalkyl group, a monovalent organic group having a substituted or unsubstituted polystyrene chain with a polymerization degree of 3 or more, a monovalent organic group having a substituted or unsubstituted alkyleneoxy group, a monovalent organic group having a substituted or unsubstituted siloxane chain, and a monovalent organic group having 12 or more carbon atoms, provided that $E^{11}$ in the formula (14) binds to Si in a main chain (—Si—O—) of the repeating structural unit of the diorganopolysiloxane of the present invention and Si in the formula (15) binds to O in the main chain (—Si—O—) of the repeating structural unit of the diorganopolysiloxane of the present invention.

In the present invention, the term "organic group" means a substituted or unsubstituted hydrocarbon group. In addition, examples of the hydrocarbon group include an alkyl group, an alkenyl group, an aryl group, and an arylalkenyl group.

Examples of the monovalent hydrocarbon groups corresponding to $R^{11}$ to $R^{16}$ include a substituted or unsubstituted alkyl group, a substituted or unsubstituted alkenyl group, a substituted or unsubstituted aryl group, and a substituted or unsubstituted arylalkenyl group. Each of those groups preferably has 1 to 30 carbon atoms. In particular, a methyl group or a phenyl group is more preferable.

The monovalent organic group having a perfluoroalkyl group, corresponding to $B^{11}$ in the formula (11), is preferably a monovalent group having a structure represented by the following formula (2).

(2)

$$—R^{21}—\left(\overset{F}{\underset{F}{C}}\right)_a—F$$

In the formula (2), $R^{21}$ represents an alkylene group or an alkyleneoxyalkylene group, and a represents an integer of 3 or more.

Examples of the alkylene group include an ethylene group and a propylene group. Examples of the alkyleneoxyalkylene group include an ethyleneoxyethylene group, an ethyleneoxypropylene group, and a propyleneoxypropylene group.

The monovalent organic group having a substituted or unsubstituted polystyrene chain with a polymerization degree of 3 or more, corresponding to $D^{11}$ in the formula (12), is preferably a monovalent group having a structure represented by the following formula (3).

(3)

$$\left(—R^{31}—\overset{R^{32}}{\underset{R^{33}}{Si}}—\right)_b—W^{31}—R^{34}$$

In the formula (3), $R^{31}$ represents a substituted or unsubstituted divalent hydrocarbon group. $R^{32}$ and $R^{33}$ each independently represent a substituted or unsubstituted alkyl group or a substituted or unsubstituted aryl group. $W^{31}$ represents a substituted or unsubstituted polystyrene chain with a polymerization degree of 3 or more. $R^{34}$ represents a substituted or unsubstituted alkyl group or a substituted or unsubstituted aryl group. b represents 0 or 1. Examples of the divalent hydrocarbon group include alkylene groups such as a methylene group, an ethylene group, and a propylene group, and the divalent hydrocarbon group preferably has 1 to 10 carbon atoms. Examples of the alkyl group include a methyl group, an ethyl group, a propyl group, and a butyl group. The aryl group is preferably unsubstituted, and examples of such a group include a phenyl group.

The monovalent organic group having a substituted or unsubstituted alkyleneoxy group, corresponding to $D^{11}$ in the formula (12), is preferably a monovalent group having a structure represented by the following formula (4).

(4)

$$—(R^{41})_c—O—(R^{42})_d—R^{43}$$

In the formula (4), $R^{41}$ and $R^{42}$ each independently represent a substituted or unsubstituted divalent hydrocarbon group. $R^{43}$ represents a hydrogen atom, or a substituted or unsubstituted monovalent hydrocarbon group. c represents 0 or 1. d represents an integer of 1 to 300.

Examples of the divalent hydrocarbon group include: alkylene groups such as a methylene group, an ethylene group, and a propylene group; and arylene groups such as a phenylene group. Examples of the monovalent hydrocarbon group include: alkyl groups such as a methyl group, an ethyl group, and a propyl group; and aryl groups such as a phenyl group. d is preferably 5 or more.

The monovalent organic group having a substituted or unsubstituted siloxane chain, corresponding to $D^{11}$ in the formula (12), is preferably a monovalent group having a structure represented by the following formula (5).

(5)

$$—R^{51}—\left(\overset{R^{52}}{\underset{R^{53}}{Si}}—O—\right)_e—\overset{R^{54}}{\underset{R^{55}}{Si}}—R^{56}$$

In the formula (5), $R^{51}$ represents an alkylene group, an alkyleneoxy group, or an oxygen atom. $R^{52}$ to $R^{56}$ each independently represent a substituted or unsubstituted alkyl group or a substituted or unsubstituted aryl group. e represents an integer of 3 or more. Examples of the alkylene group include an ethylene group and a propylene group. Examples of the alkyleneoxy group include an ethyleneoxy group and a propyleneoxy group. Examples of the alkyl group include a methyl group and an ethyl group. Examples of the aryl group include a phenyl group. e is preferably 5 or more.

Examples of the monovalent organic group having 12 or more carbon atoms, corresponding to $D^{11}$ in the formula (12), include alkyl groups such as an n-dodecyl group, an n-tetradodecyl group, an n-hexadecyl group, and an n-octadecyl group. The monovalent organic group preferably has 100 or less carbon atoms.

Examples of a substituent which each of the above groups may have include: a halogen atom such as a fluorine atom, a chlorine atom, and an iodine atom; an alkyl group such as a methyl group, an ethyl group, and a propyl group; and an aryl group such as a phenyl group.

The average number of repeating structural units a each represented by the formula (11) in the diorganopolysiloxane of the present invention is preferably in the range of 1 to 1,000, particularly preferably in the range of 10 to 200.

The average number of repeating structural units β each represented by the formula (12) in the diorganopolysiloxane of the present invention is preferably in the range of 1 to 1,000, particularly preferably in the range of 5 to 100.

The average number of repeating structural units γ each represented by the formula (13) in the diorganopolysiloxane of the present invention is preferably in the range of 0 to 1,000, particularly preferably in the range of 100 to 200.

The total number of repeating structural units α and β (α, β, and γ if γ is included) in the diorganopolysiloxane of the present invention accounts for preferably 80% or more, particularly preferably 100% of the total number of all the repeating structural units.

The average sum of the number of repeating structural units α each represented by the formula (11), the number of repeating structural units β each represented by the formula (12), and the number of repeating structural units γ each represented by the formula (13) in the diorganopolysiloxane of the present invention is preferably in the range of 2 to 2,000, more preferably in the range of 5 to 1,000, still more preferably in the range of 20 to 500.

If the number of repeating structural units a each represented by the formula (11) is 2 or more, multiple $R^{11}$'s may be the same group or 2 or more different groups, and multiple $B^{11}$ may be the same group or 2 or more different groups.

If the number of repeating structural units β each represented by the formula (12) is 2 or more, multiple $R^{12}$'s may be the same group or 2 or more different groups, and multiple $D^{11}$'s may be the same group or 2 or more different groups. As described above, $D^{11}$ represents any one of a monovalent organic group having a substituted or unsubstituted polystyrene chain with a polymerization degree of 3 or more, a monovalent organic group having a substituted or unsubstituted alkyleneoxy group, a monovalent organic group having a substituted or unsubstituted siloxane chain, and a monovalent organic group having 12 or more carbon atoms. If the number of $D^{11}$'s is 2 or more, at least one $D^{11}$ preferably represents a monovalent organic group having a substituted or unsubstituted siloxane chain.

If the number of repeating structural units γ each represented by the formula (13) is 2 or more, multiple $R^{13}$'s may be the same group or 2 or more different groups, and multiple $R^{14}$'s may be the same group or 2 or more different groups.

The same holds true for $R^{32}$ and $R^{33}$ in the formula (3), $R^{42}$ in the formula (4), and $R^{52}$ and $R^{53}$ in the formula (5).

The diorganopolysiloxane of the present invention has a weight average molecular weight in the range of preferably 1,000 to 1,000,000, more preferably 10,000 to 200,000, still more preferably 10,000 to 100,000, and still more preferably 10,000 to 50,000.

The weight average molecular weight of the diorganopolysiloxane of the present invention can be measured by means of gel permeation chromatography (GPC).

The diorganopolysiloxane of the present invention has a fluorine atom content in the range of preferably 1 to 90 mass %, and particularly preferably 5 to 60 mass % with respect to the total mass of the diorganopolysiloxane. An excessively low fluorine atom content may cause the releasability of the surface layer of the electrophotographic photoreceptor to be insufficiently exerted. In contrast, an excessively high fluorine atom content may result in poor compatibility with the binder resin in the surface layer of the electrophotographic photoreceptor, or may make it impossible to obtain a sufficient anchor effect. As a result, the diorganopolysiloxane tends to migrate to the surface of the surface layer, and a sufficient releasing effect is not obtained in some cases when the surface of the electrophotographic photoreceptor is worn out through repeated use. The diorganopolysiloxane of the present invention has suppressed the migration characteristics in the surface layer of the electrophotographic photoreceptor because $D^{11}$ in a side chain has a remarkable anchor effect to the binder resin in the surface layer.

The fluorine atom content in the diorganopolysiloxane can be measured by means of, for example, X-ray photoelectron spectroscopy (ESCA).

Specific examples of the diorganopolysiloxane of the present invention will be shown below. However, the present invention is not limited to these specific examples. In addition, each of the following diorganopolysiloxanes (1—1) to (1-23) has the terminal group I having the structure represented by the formula (14) ($E^{11}$: methyl group) and the terminal group II having the structure represented by the formula (15) ($E^{12}$, $R^{15}$, $R^{16}$: methyl groups). In addition, the respective repeating structural units are preferably arranged at random.

[Table 1-24]

TABLE 1-2

| | Repeating structural unit | Structure | Average number |
|---|---|---|---|
| (1-1) | α | 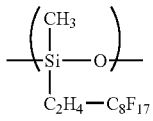 | 30 |
| | β | 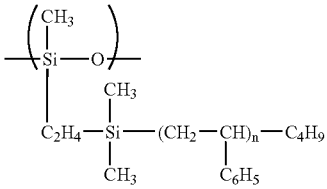 | 30<br>n = 25<br>(average number) |
| | γ | 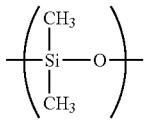 | 31 |

TABLE 1-2-continued

| | Repeating structural unit | Structure | Average number |
|---|---|---|---|
| (1-2) | α | 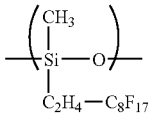 | 30 |
| | β | 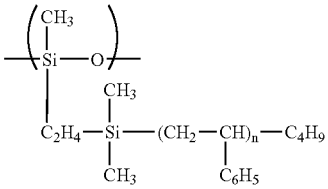 | 15 n = 25 (average number) |
| | γ | 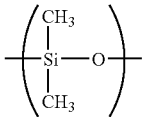 | 48 |

TABLE 3

| | Repeating structural unit | Structure | Average number |
|---|---|---|---|
| (1-3) | α | 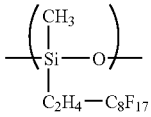 | 30 |
| | β | 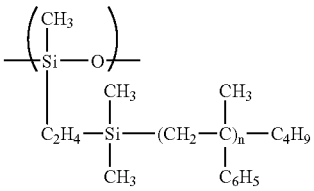 | 15 n = 25 (average number) |
| | γ | 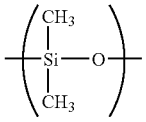 | 46 |

TABLE 4-5

| | Repeating structural unit | Structure | Average number |
|---|---|---|---|
| (1-4) | α | 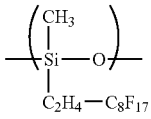 | 30 |

TABLE 4-5-continued

| | Repeating structural unit | Structure | Average number |
|---|---|---|---|
| | β | 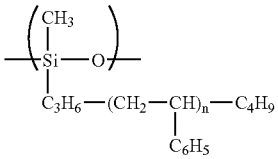 | 30 n = 25 (average number) |
| | γ | 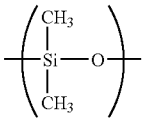 | 31 |
| (1-5) | α | 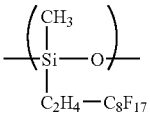 | 30 |
| | β | 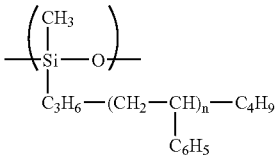 | 15 n = 25 (average number) |
| | γ | 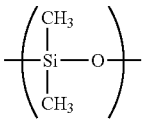 | 48 |

TABLE 6

| | Repeating structural unit | Structure | Average number |
|---|---|---|---|
| (1-6) | α | 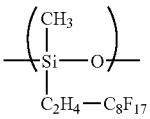 | 30 |
| | β | 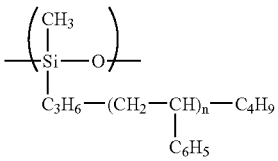 | 15 n = 25 (average number) |
| | γ | 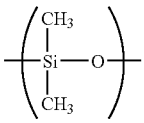 | 16 |
| | | 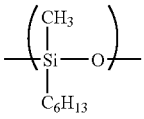 | 15 |

TABLE 7

| | Repeating structural unit | Structure | Average number |
|---|---|---|---|
| (1-7) | α | 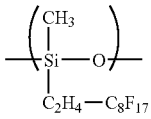 | 60 |
| | β | 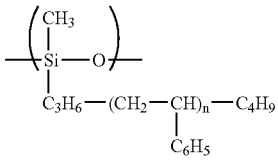 | 30 n = 25 (average number) |
| | γ | 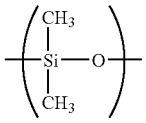 | 61 |
| | | 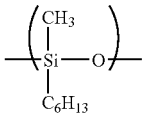 | 30 |

TABLE 8

| | Repeating structural unit | Structure | Average number |
|---|---|---|---|
| (1-8) | α | 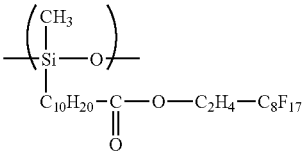 | 30 |
| | β | 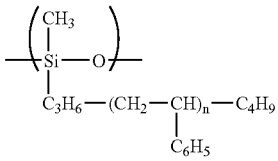 | 15 n = 25 (average number) |
| | γ | 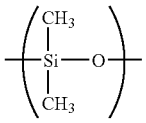 | 46 |

TABLE 9

| | Repeating structural unit | Structure | Average number |
|---|---|---|---|
| (1-9) | α | 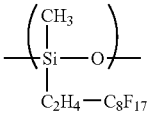 | 30 |

TABLE 9-continued

| | Repeating structural unit | Structure | Average number |
|---|---|---|---|
| | β | 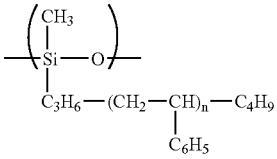 | 15 n = 25 (average number) |
| | | 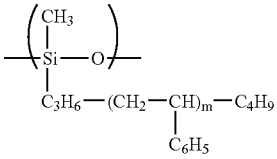 | 15 n = 50 (average number) |
| | γ | 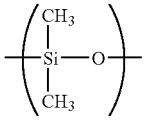 | 31 |

TABLE 10

| | Repeating structural unit | Structure | Average number |
|---|---|---|---|
| (1-10) | α | 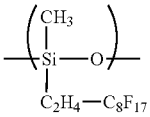 | 30 |
| | β | 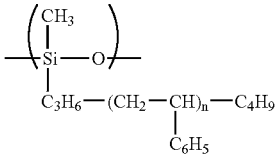 | 15 n = 25 (average number) |
| | γ | 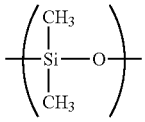 | 31 |
| | | 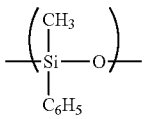 | 15 |

TABLE 11

| | Repeating structural unit | Structure | Average number |
|---|---|---|---|
| (1-11) | α | 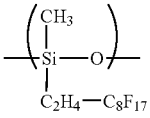 | 30 |

TABLE 11-continued

| Repeating structural unit | Structure | Average number |
|---|---|---|
| β | $-\left(\begin{array}{c}CH_3\\ \mid\\ Si-O\\ \mid\\ C_3H_6-(CH_2-\underset{\underset{C_6H_5}{\mid}}{CH})_n-C_4H_9\end{array}\right)-$ | 15<br>n = 50<br>(average number) |
| γ | $-\left(\begin{array}{c}CH_3\\ \mid\\ Si-O\\ \mid\\ CH_3\end{array}\right)-$ | 46 |

TABLE 12

| | Repeating structural unit | Structure | Average number |
|---|---|---|---|
| (1-12) | α | $-\left(\begin{array}{c}CH_3\\ \mid\\ Si-O\\ \mid\\ C_2H_4-C_8F_{17}\end{array}\right)-$ | 10 |

TABLE 12-continued

| Repeating structural unit | Structure | Average number |
|---|---|---|
| β | $-\left(\begin{array}{c}CH_3\\ \mid\\ Si-O\\ \mid\\ C_3H_6-(CH_2-\underset{\underset{C_6H_5}{\mid}}{CH})_n-C_4H_9\end{array}\right)-$ | 10<br>n = 50<br>(average number) |
| γ | $-\left(\begin{array}{c}CH_3\\ \mid\\ Si-O\\ \mid\\ CH_3\end{array}\right)-$ | 11 |
| | $-\left(\begin{array}{c}CH_3\\ \mid\\ Si-O\\ \mid\\ C_6H_{13}\end{array}\right)-$ | 10 |

TABLE 13

| | Repeating structural unit | Structure | Average number |
|---|---|---|---|
| (1-13) | α | $-\left(\begin{array}{c}CH_3\\ \mid\\ Si-O\\ \mid\\ C_2H_4-C_8F_{17}\end{array}\right)-$ | 30 |
| | β | $-\left(\begin{array}{c}CH_3\\ \mid\\ Si-O\\ \mid\\ C_3H_6-O-(CH_2-\underset{\underset{CH_3}{\mid}}{CH}-O)_n-(C_2H_4-O)_m-CH_3\end{array}\right)-$ | 30<br>n = 25<br>m = 25<br>(average number) |
| | γ | $-\left(\begin{array}{c}CH_3\\ \mid\\ Si-O\\ \mid\\ CH_3\end{array}\right)-$ | 31 |

TABLE 14

| | Repeating structural unit | Structure | Average number |
|---|---|---|---|
| (1-14) | α | $-\left(\begin{array}{c}CH_3\\ \mid\\ Si-O\\ \mid\\ C_2H_4-C_8F_{17}\end{array}\right)-$ | 30 |

TABLE 14-continued

| Repeating structural unit | Structure | Average number |
|---|---|---|
| β | $-\left(\begin{array}{c}CH_3\\ \mid\\ Si-O\\ \mid\\ C_3H_6-O-(CH_2-\underset{\underset{CH_3}{\mid}}{CH}-O)_n-(C_2H_4-O)_m-CH_3\end{array}\right)-$ | 15<br>n = 25<br>m = 25<br>(average number) |
| | $-\left(\begin{array}{c}CH_3\\ \mid\\ Si-O\\ \mid\\ C_3H_6-O-(CH_2-\underset{\underset{CH_3}{\mid}}{CH}-O)_p-(C_2H_4-O)_q-CH_3\end{array}\right)-$ | 15<br>p = 50<br>q = 50<br>(average number) |
| γ | $-\left(\begin{array}{c}CH_3\\ \mid\\ Si-O\\ \mid\\ CH_3\end{array}\right)-$ | 31 |

TABLE 15-16

| | Repeating structural unit | Structure | Average number |
|---|---|---|---|
| (1-15) | α | $-\left(\begin{array}{c}CH_3\\ \mid\\ Si-O\\ \mid\\ C_2H_4-C_8F_{17}\end{array}\right)-$ | 30 |
| | β | $-\left(\begin{array}{c}CH_3\\ \mid\\ Si-O\\ \mid\\ C_3H_6-O-(C_2H_4-O)_n-CH_3\end{array}\right)-$ | 15<br>n = 40<br>(average number) |
| | γ | $-\left(\begin{array}{c}CH_3\\ \mid\\ Si-O\\ \mid\\ CH_3\end{array}\right)-$ | 46 |
| (1-16) | α | $-\left(\begin{array}{c}CH_3\\ \mid\\ Si-O\\ \mid\\ C_{10}H_{20}-\underset{\underset{O}{\parallel}}{C}-O-C_2H_4-C_8F_{17}\end{array}\right)-$ | 30 |
| | β | $-\left(\begin{array}{c}CH_3\\ \mid\\ Si-O\\ \mid\\ C_3H_6-O-(CH_2-\underset{\underset{CH_3}{\mid}}{CH}-O)_n-(C_2H_4-O)_m-CH_3\end{array}\right)-$ | 30<br>n = 25<br>m = 25<br>(average number) |

TABLE 15-16-continued

| Repeating structural unit | Structure | Average number |
|---|---|---|
| γ | 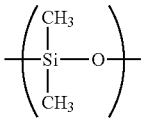 | 31 |

TABLE 17-18

| | Repeating structural unit | Structure | Average number |
|---|---|---|---|
| (1-17) | α | 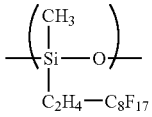 | 30 |
| | β | 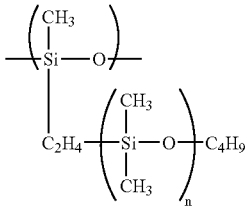 | 30<br>n = 50<br>(average number) |
| | γ | 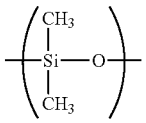 | 31 |
| (1-18) | α | 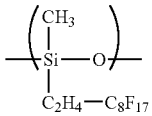 | 25 |
| | β | 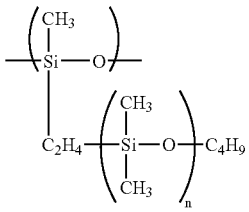 | 10<br>n = 100<br>(average number) |
| | γ | 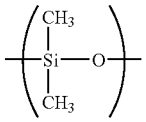 | 51 |

TABLE 19

| | Repeating structural unit | Structure | Average number |
|---|---|---|---|
| (1-19) | α | 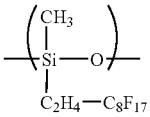 | 30 |
| | β | 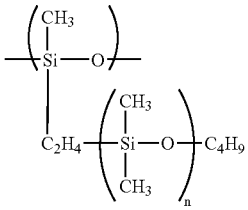 | 25<br>n = 25<br>(average number) |
| | | 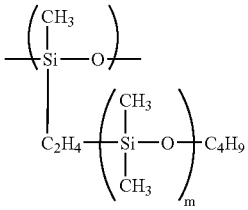 | 25<br>m = 50<br>(average number) |
| | γ | 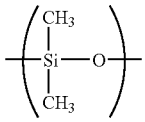 | 51 |

TABLE 20

| | Repeating structural unit | Structure | Average number |
|---|---|---|---|
| (1-20) | α | 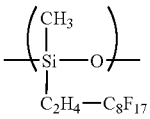 | 50 |
| | β | 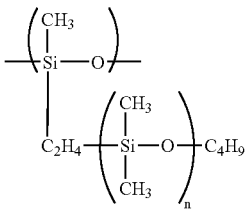 | 25<br>n = 50<br>(average number) |

TABLE 20-continued

| | Repeating structural unit | Structure | Average number |
|---|---|---|---|
| | γ | $-\left(\begin{array}{c}CH_3\\ \mid\\ Si-O\\ \mid\\ CH_3\end{array}\right)-$ | 51 |
| | | $-\left(\begin{array}{c}CH_3\\ \mid\\ Si-O\\ \mid\end{array}\right)-$ $CH_2-\underset{\underset{CH_3}{\mid}}{CH}-C_6H_5$ | 25 |

TABLE 21-22

| | Repeating structural unit | Structure | Average number |
|---|---|---|---|
| (1-21) | α | $-\left(\begin{array}{c}CH_3\\ \mid\\ Si-O\\ \mid\end{array}\right)-$ $C_2H_4-C_8F_{17}$ | 45 |
| | β | $-\left(\begin{array}{c}CH_3\\ \mid\\ Si-O\\ \mid\end{array}\right)-$ $C_2H_4-\left(\begin{array}{c}CH_3\\ \mid\\ Si-O\\ \mid\\ CH_3\end{array}\right)_n-\begin{array}{c}CH_3\\ \mid\\ Si-C_4H_9\\ \mid\\ CH_3\end{array}$ | 10 n = 130 (average number) |
| | γ | $-\left(\begin{array}{c}CH_3\\ \mid\\ Si-O\\ \mid\\ CH_3\end{array}\right)-$ | 51 |
| (1-22) | α | $-\left(\begin{array}{c}CH_3\\ \mid\\ Si-O\\ \mid\end{array}\right)-$ $C_2H_4-C_8F_{17}$ | 25 |
| | β | $-\left(\begin{array}{c}CH_3\\ \mid\\ Si-O\\ \mid\end{array}\right)-$ $C_{18}H_{37}$ | 25 |
| | γ | $-\left(\begin{array}{c}CH_3\\ \mid\\ Si-O\\ \mid\\ CH_3\end{array}\right)-$ | 26 |

TABLE 23-24

| | Repeating structural unit | Structure | Average number |
|---|---|---|---|
| (1-23) | α | $-\left(\begin{array}{c}CH_3\\ \mid\\ Si-O\\ \mid\end{array}\right)-$ $C_2H_4-C_8F_{17}$ | 25 |
| | β | $-\left(\begin{array}{c}CH_3\\ \mid\\ Si-O\\ \mid\end{array}\right)-$ $C_{40}H_{81}$ | 25 |
| | γ | $-\left(\begin{array}{c}CH_3\\ \mid\\ Si-O\\ \mid\\ CH_3\end{array}\right)-$ | 26 |
| (1-24) | α | $-\left(\begin{array}{c}CH_3\\ \mid\\ Si-O\\ \mid\end{array}\right)-$ $C_2H_4-C_8F_{17}$ | 25 |
| | β | $-\left(\begin{array}{c}CH_3\\ \mid\\ Si-O\\ \mid\end{array}\right)-$ $C_2H_4-C_6H_5$ | 25 |
| | γ | $-\left(\begin{array}{c}CH_3\\ \mid\\ Si-O\\ \mid\\ CH_3\end{array}\right)-$ | 26 |

Of the above (1—1) to (1-24), (1—1), (1-4), (1-7), (1-9), (1-12), (1-17), (1-22), and (1-24) are preferable, and (1-4), (1-17), (1-22), and (1-24) are particularly preferable.

The diorganopolysiloxane of the present invention can be produced in accordance with a method described in, for example, JP-A 2000-081715 or JP-A 2001-249481. Synthesis examples of the diorganopolysiloxane of the present invention are shown in EXAMPLES to be described later.

Next, the configuration of the electrophotographic photoreceptor of the present invention will be described.

As described above, the electrophotographic photoreceptor of the present invention may have a support and a photosensitive layer placed on the support.

The photosensitive layer may be any one of: a monolayer photosensitive layer containing a charge transporting substance and a charge generating substance in the same layer; and a laminated (separated-function) photosensitive layer separated into a charge generating layer containing a charge generating substance and a charge transporting layer containing a charge transporting substance. The photosensitive layer is preferably a laminated photosensitive layer from the viewpoints of electrophotographic characteristics. The laminated photosensitive layers are classified into: a forward-laminated photosensitive layer in which a charge generating layer and a charge transporting layer are laminated in this order from the side of a support; and a reverse-laminated photosensitive layer in which a charge transporting layer and a charge generating layer are laminated in this order from the side of a support. A forward-laminated photosensitive layer is preferable from the viewpoints of electrophotographic characteristics. In addition, a charge generating layer may be of a laminated structure, or a charge transporting layer may be of a laminated structure.

In addition, a protective layer may be placed on the photosensitive layer for the purpose of protecting the photosensitive layer.

FIG. 1 shows an example of a layer configuration of the electrophotographic photoreceptor to be used in the present invention.

In an electrophotographic photoreceptor having a layer configuration shown in FIG. 1(*a*), a monolayer photosensitive layer 104 containing a charge generating substance and a charge transporting substance is placed on a support 101. In the electrophotographic photoreceptor having the layer configuration shown in FIG. 1(*a*), the monolayer photosensitive layer 104 serves as a surface layer and contains the diorganopolysiloxane of the present invention.

In an electrophotographic photoreceptor having a layer configuration shown in FIG. 1(*b*), a charge generating layer 1041 containing a charge generating substance is placed on a support 101, and a charge transporting layer 1042 containing a charge transporting substance is placed on the charge generating layer 1041. In other words, a photosensitive layer 104 of the electrophotographic photoreceptor having the layer configuration shown in FIG. 1(*b*) is a laminated (forward-laminated) photosensitive layer having the charge generating layer 1041 and the charge transporting layer 1042. In the electrophotographic photoreceptor having the layer configuration shown in FIG. 1(*b*), the charge transporting layer 1042 serves as a surface layer and contains the diorganopolysiloxane of the present invention.

In addition, as shown in FIG. 1(*c*) or (*d*), a protective layer 105 serving as the surface layer of an electrophotographic photoreceptor may be placed on a photosensitive layer 104. In the electrophotographic photoreceptor having the layer configuration shown in FIG. 1(*c*) or (*d*), the protective layer 105 serves as a surface layer and contains the diorganopolysiloxane of the present invention.

Any other layer configuration can be employed as long as the surface layer of an electrophotographic photoreceptor, that is, a layer placed at the outermost surface of the electrophotographic photoreceptor, contains the diorganopolysiloxane of the present invention.

The content of the diorganopolysiloxane of the present invention in the surface layer is in the range of preferably 0.01 to 20 mass %, and more preferably 0.1 to 10 mass % with respect to the total mass of the surface layer.

The support has only to be conductive (conductive support), and, for example, a metal support (including an alloy support) made of aluminum, an aluminum alloy, stainless steel, or the like can be used. The metal support or a plastic support having a layer formed by vacuum deposition of aluminum, an aluminum alloy, an indium oxide-tin oxide alloy, or the like, can also be used. A plastic or a paper support obtained by immersing a conductive particle such as carbon black, a tin oxide particle, a titanium oxide particle, or a silver particle with an appropriate binder resin in plastic or paper, a plastic support having a conductive binder resin, or the like can also be used. Examples of the shape of the support include a cylindrical shape and a belt shape. Of those, a cylindrical shape is preferable.

In addition, the surface of the support may be subjected to a cutting treatment, a surface roughening treatment, an alumite treatment, or the like, for the purpose of preventing an interference fringe from occurring owing to the scattering of laser light or the like.

A conductive layer may be interposed between the support and the photosensitive layer (including the charge generating layer and the charge transporting layer) or an intermediate layer to be described later, to prevent an interference fringe from occurring owing to the scattering of laser light or the like, or to cover a scratch on the support.

The conductive layer can be formed by dispersing a conductive particle, such as carbon black, a metal particle, or a metal oxide particle into a binder resin.

The conductive layer has a thickness in the range of preferably 1 to 40 μm, and particularly preferably 2 to 20 μm.

An intermediate layer having a barrier function or an adhesion function may be interposed between the support or the conductive layer and the photosensitive layer (including the charge generating layer and the charge transporting layer). The intermediate layer is formed: for improving the adhesiveness and coatability of the photosensitive layer, and a charge injection to the photosensitive layer from the support; for protecting the photosensitive layer against electrical breakdown; and for other purposes.

The intermediate layer can be formed of a material including: a resin such as an acrylic resin, an allyl resin, an alkyd resin, an ethylcellulose resin, an ethylene-acrylic copolymer, an epoxy resin, a casein resin, a silicone resin, a gelatin resin, nylon, a phenol resin, a butyral resin, a polyacrylate resin, a polyacetal resin, a polyamideimide resin, a polyamide resin, a polyallylether resin, a polyimide resin, a polyurethane resin, a polyester resin, a polyethylene resin, a polycarbonate resin, a polystyrene resin, a polysulfone resin, a polyvinylalcohol resin, a polybutadiene resin, a polypropylene resin, or a urea resin; or an aluminum oxide.

The intermediate layer has a thickness in the range of preferably 0.05 to 5 μm, particularly preferably 0.3 to 1 μm.

Examples of the charge generating substance to be used in the electrophotographic photoreceptor of the present invention include: azo pigments such as monoazo, disazo, and trisazo pigments; phthalocyanine pigments such as metal phthalocyanine and non-metal phthalocyanine pigments; indigo pigments such as indigo and thioindigo pigments; perylene pigments such as perylenic anhydride and perylenic imide; polycyclic quinone pigments such as anthraquinone, pyrenequinone, and dibenzopyrenequinone pigments; squalelium dyestuffs; pyrylium salts and thiapyrylium salts; triphenylmethane dyestuffs; inorganic substances such as selenium, selenium-tellurium, and amorphous silicon; quinacridone pigments; azulenium salt pigments; cyanine dyes such as quinocyanine; anthanthrone pigments; pyranthrone pigments; xanthene dyestuffs; quinoneimine dyestuffs; styryl dyestuffs; cadmium sulfide; and zinc oxide. Each of those charge generating substances may be used alone, or two or more of them may be used in combination.

In the case where the photosensitive layer is a laminated photosensitive layer, examples of the binder resin to be used in the charge generating layer include an acrylic resin, an allyl resin, an alkyd resin, an epoxy resin, a diallylphthalate resin, a silicone resin, a styrene-butadiene copolymer, nylon, a phenol resin, a butyral resin, a benzal resin, a polyacrylate resin, a polyacetal resin, a polyamideimide resin, a polyamide resin, a polyallylether resin, a polyallylate resin, a polyimide resin, a polyurethane resin, a polyester resin, a polyethylene resin, a polycarbonate resin, a polystyrene resin, a polysulfone resin, a polyvinyl acetal resin, a polybutadiene resin, a polypropylene resin, a methacrylic resin, a urea resin, a vinyl chloride-vinyl acetate copolymer, a vinyl acetate resin, and a vinyl chloride resin. Of those, a butyral resin or the like is particularly preferable. Each of those resins may be used alone, or two or more of them may be used as a mixture or a copolymer.

In the case where the charge generating layer is the surface layer of the electrophotographic photoreceptor, the diorganopolysiloxane of the present invention is incorporated into the charge generating layer.

The charge generating layer can be formed by: applying an application liquid for a charge generating layer obtained by dispersing a charge generating substance and a binder resin (and, in addition, the diorganopolysiloxane of the present invention when the charge generating layer is the surface layer of the electrophotographic photoreceptor) into a solvent; and drying the applied liquid. Examples of a dispersing method include methods using a homogenizer, an ultrasonic dispersing device, a ball mill, a sand mill, a roll mill, a vibration mill, an atliter, a liquid-colliding high speed dispersing device, and the like. A ratio between the charge generating substance and the binder resin is preferably in the range of 1:0.3 to 1:4 (mass ratio).

The solvent to be used for the application liquid for a charge generating layer is selected in consideration of the solubility and dispersion stability of each of the binder resin and the charge generating substance to be used. Examples of the solvent include an alcohol, a sulfoxide, a ketone, an ether, an ester, an aliphatic halogenated hydrocarbon, and an aromatic compound.

The charge generating layer has a thickness of preferably 5 μm or less, particularly preferably 0.1 to 2 μm.

Any one of various sensitizers, antioxidants, ultraviolet absorbers, plasticizers, and the like may be added as required to the charge generating layer.

Examples of the charge transporting substance to be used in the electrophotographic photoreceptor of the present invention include a triarylamine compound, a hydrazone compound, a styryl compound, a stilbene compound, a pyrazoline compound, an oxazole compound, a thiazole compound, and a triarylmethane compound. Each of those charge transporting substances may be used alone, or two or more of them may be used in combination.

In the case where the photosensitive layer is a laminated photosensitive layer, examples of the binder resin to be used in the charge transporting layer include an acrylic resin, an acrylonitrile resin, an allyl resin, an alkyd resin, an epoxy resin, a silicone resin, nylon, a phenol resin, a phenoxy resin, a butyral resin, a polyacrylamide resin, a polyacetal resin, a polyamideimide resin, a polyamide resin, a polyallylether resin, a polyallylate resin, a polyimide resin, a polyurethane resin, a polyester resin, a polyethylene resin, a polycarbonate resin, a polystyrene resin, a polysulfone resin, a polyvinyl butyral resin, a polyphenyleneoxide resin, a polybutadiene resin, a polypropylene resin, a methacrylic resin, a urea resin, a vinyl chloride resin, and a vinyl acetate resin. Each of those resins may be used alone, or two or more of them may be used as a mixture or a copolymer.

In the case where the charge transporting layer is the surface layer of the electrophotographic photoreceptor, the diorganopolysiloxane of the present invention is incorporated into the charge transporting layer.

The charge transporting layer can be formed by: applying an application liquid for a charge transporting layer obtained by dispersing a charge transporting substance and a binder resin (and, in addition, the diorganopolysiloxane of the present invention when the charge transporting layer is the surface layer of the electrophotographic photoreceptor) into a solvent; and drying the applied liquid. A ratio between the charge transporting substance and the binder resin is in the range of preferably 5:1 to 1:5 (mass ratio), particularly preferably 3:1 to 1:3 (mass ratio).

Examples of the solvent to be used for the application liquid for a charge transporting layer include: ketones such as acetone and methyl ethyl ketone; esters such as methyl acetate and ethyl acetate; aromatic hydrocarbons such as toluene and xylene; ethers such as 1,4-dioxane and tetrahydrofuran; and hydrocarbons substituted by halogen atoms such as chlorobenzene, chloroform, and carbon tetrachloride.

The charge transporting layer has a thickness in the range of preferably 5 to 50 μm, particularly preferably 10 to 30 μm.

In addition, an antioxidant, an ultraviolet absorber, a plasticizer, or the like may be added as required to the charge transporting layer.

In the case where the photosensitive layer is a monolayer photosensitive layer, the monolayer photosensitive layer can be formed by: applying an application liquid for a monolayer photosensitive layer obtained by dispersing the charge generating substance, the charge transporting substance, and a binder resin into the solvent; and drying the applied liquid. Each of the above various resins can be used as the binder resin for the monolayer photosensitive layer.

In the case where the monolayer photosensitive layer is the surface layer of the electrophotographic photoreceptor, the diorganopolysiloxane of the present invention is incorporated into the monolayer photosensitive layer.

In addition, as described above, a protective layer may be placed on a photosensitive layer for the purpose of protecting the photosensitive layer. The protective layer can be formed by: applying an application liquid for a protective layer obtained by dispersing a binder resin and the diorganopolysiloxane of the present invention into a solvent; and drying the applied liquid. The protective layer can also be formed by: applying an application liquid for a protective layer obtained by dispersing a monomer/oligomer to form a binder resin and the diorganopolysiloxane into a solvent; and curing and/or drying the applied liquid. Light, heat, or a radial ray (such as an electron beam) may be used for the curing.

The same resin as the binder resin for the photosensitive layer can be used as the binder resin for the protective layer.

The protective layer has a thickness preferably in the range of 0.05 to 20 μm.

In applying the application liquids for the above respective layers, coating methods such as a dip coating method, a spray coating method, a spinner coating method, a roller coating method, a Meier bar coating method, and a blade coating method can be used.

As described above, each of various resins can be used as the binder resin for the respective layers of the electrophotographic photoreceptor of the present invention. Of the various resins, each of a polycarbonate resin and a polyallylate resin is suitably used as the binder resin for the surface layer of the electrophotographic photoreceptor from the viewpoint of compatibility with the diorganopolysiloxane to be incorporated into the surface layer.

The polycarbonate resin to be used in combination with the diorganopolysiloxane of the present invention has a weight-average molecular weight in the range of preferably 20,000 to 300,000, more preferably 50,000 to 150,000.

In addition, the polyallylate resin to be used in combination with the diorganopolysiloxane of the present invention has a weight-average molecular weight in the range of preferably 20,000 to 300,000, more preferably 50,000 to 150,000.

The weight-average molecular weight of the binder resin is measured as in the weight-average molecular weight of the diorganopolysiloxane.

The polycarbonate resin is preferably a polycarbonate resin having a repeating structural unit represented by the following formula (6).

(6)

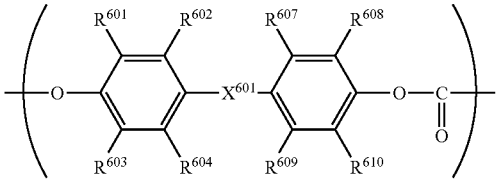

In the formula (6), $X^{601}$ represents a single bond, a carbonyl group, an ether group, a thioether group, or a —C($R^{605}$)($R^{606}$)-group (where $R^{605}$ and $R^{606}$ each independently represent a hydrogen atom, a substituted or unsubstituted alkyl group, or a substituted or unsubstituted aryl group, or $R^{605}$ and $R^{606}$ bind to form a substituted or unsubstituted cycloalkylidene group), and $R^{601}$ to $R^{604}$ and $R^{607}$ to $R^{610}$ each independently represent a hydrogen atom, a halogen atom, a substituted or unsubstituted alkyl group, or a substituted or unsubstituted aryl group.

Of those, $X^{601}$ preferably represents a single bond or a —C($R^{605}$)($R^{606}$)-group, and each of $R^{602}$, $R^{604}$, $R^{607}$, and $R^{609}$ preferably represents a hydrogen atom.

In addition, the polyallylate resin is preferably a polyallylate resin having a repeating structural unit represented by the following formula (7).

(7)

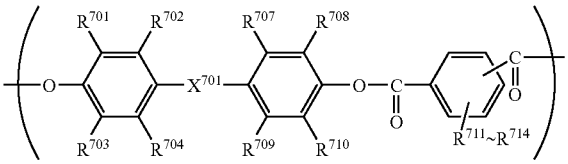

In the formula (7), $X^{701}$ represents a single bond, a carbonyl group, an ether group, a thioether group, or a —C($R^{705}$)($R^{706}$)-group (where $R^{705}$ and $R^{706}$ each independently represent a hydrogen atom, a substituted or unsubstituted alkyl group, or a substituted or unsubstituted aryl group, or $R^{705}$ and $R^{706}$ bind to form a substituted or unsubstituted cycloalkylidene group), and $R^{701}$ to $R^{704}$ and $R^{707}$ to $R^{714}$ each independently represent a hydrogen atom, a halogen atom, a substituted or unsubstituted alkyl group, or a substituted or unsubstituted aryl group.

Of those, $X^{701}$ preferably represents a single bond or a —C($R^{705}$)($R^{706}$)-group, and each of $R^{702}$, $R^{704}$, $R^{707}$, and $R^{709}$ preferably represents a hydrogen atom.

Examples of the halogen atoms for $R^{601}$ to $R^{610}$ in the formula (6) and $R^{701}$ to $R^{714}$ in the formula (7) include a fluorine atom, a chlorine atom, and an iodine atom. Examples of the alkyl groups for the same include a methyl group, an ethyl group, and a propyl group. Examples of the aryl groups for the same include a phenyl group and a naphthyl group. Examples of the alkylidene groups for the same include a cyclohexylidene group.

Examples of a substituent which each of the above groups may have include: halogen atoms such as a fluorine atom, a chlorine atom, and an iodine atom; alkyl groups such as a methyl group, an ethyl group, and a propyl group; and aryl groups such as a phenyl group.

Specific examples of the repeating structural unit represented by the formula (6) will be shown below.

(6-1)

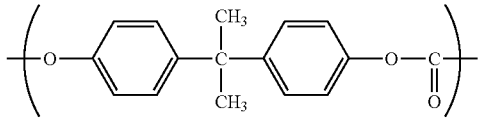

(6-2)

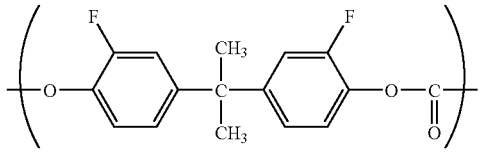

(6-3)

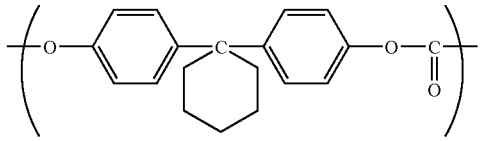

(6-4)

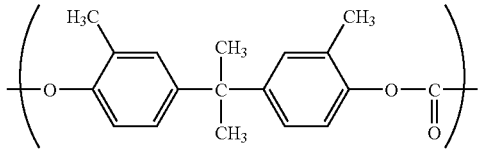

(6-5)

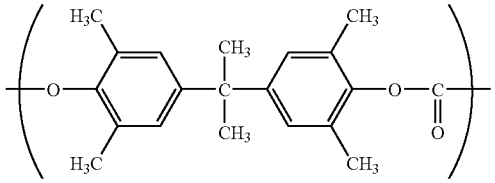

(6-6)

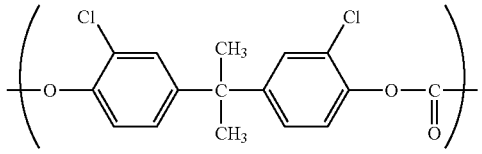

(6-7)

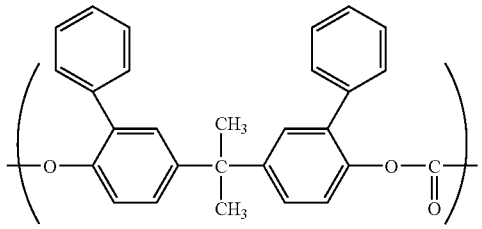

(6-8)

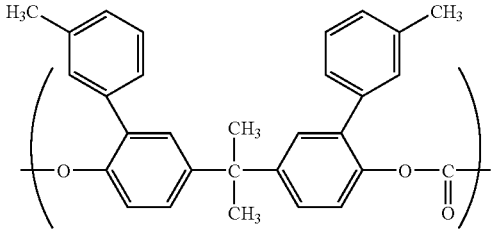

-continued
(6-9)
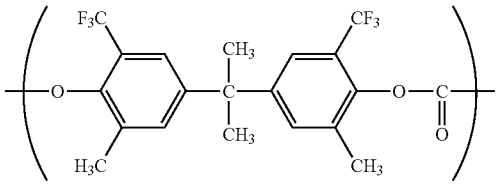
(6-10)
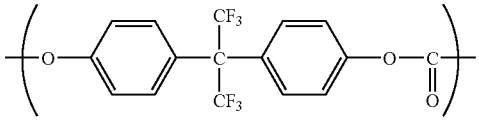
(6-11)
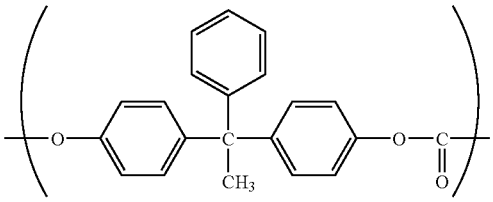
(6-12)
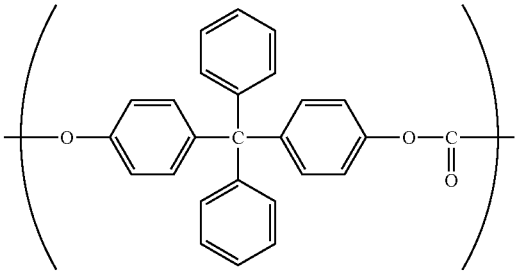
(6-13)
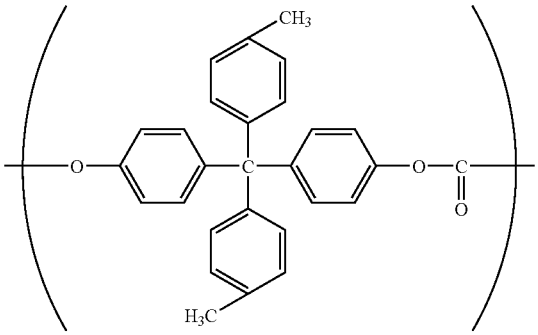
(6-14)
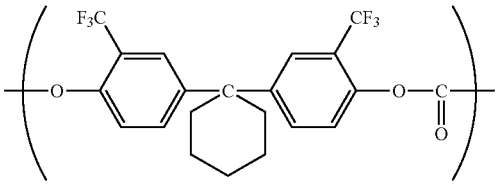
-continued
(6-15)
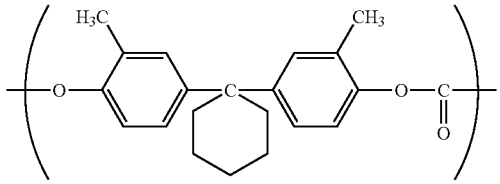
(6-16)
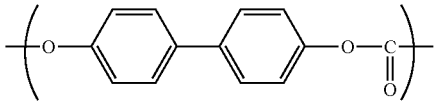
Of the above (6-1) to (6-16), (6-1), (6-3), (6-4), (6-10), and (6-16) are preferable, and (6-1), (6-3), and (6-16) are particularly preferable.
Specific examples of the repeating structural unit represented by the formula (7) will be shown below.
(7-1)
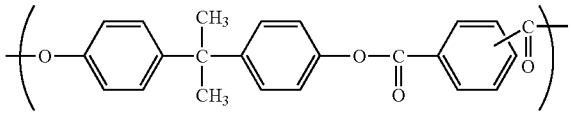
(7-2)
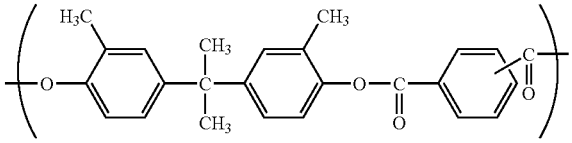
(7-3)
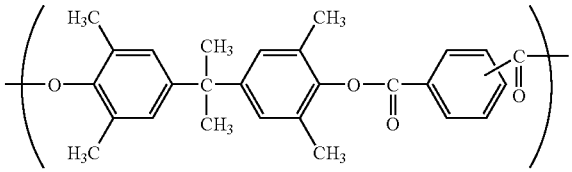
(7-4)
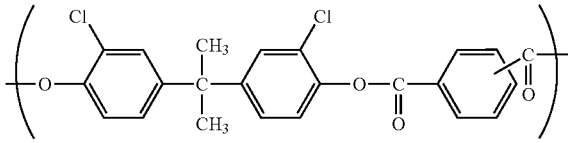
(7-5)
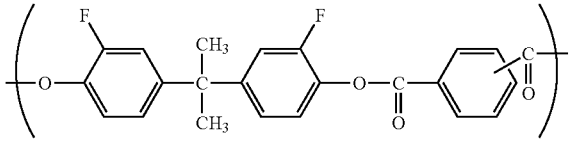

-continued
(7-6)
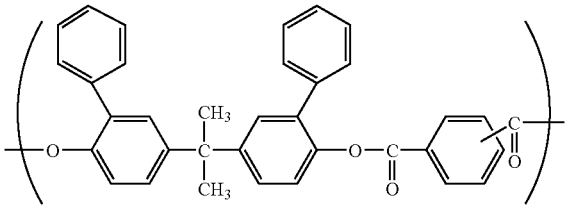
(7-7)
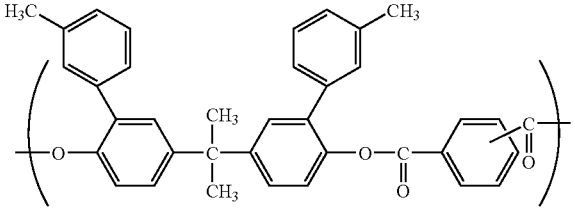
(7-8)
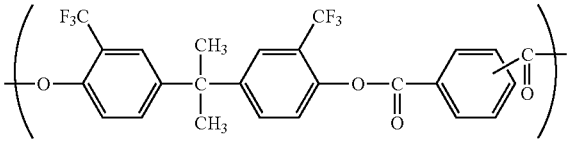
(7-9)
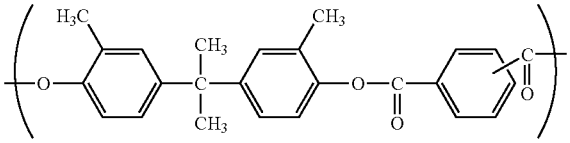
(7-10)
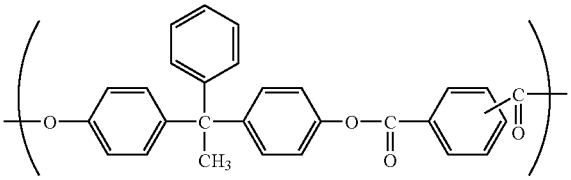
(7-11)
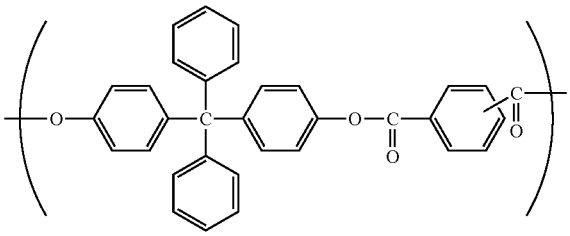
(7-12)
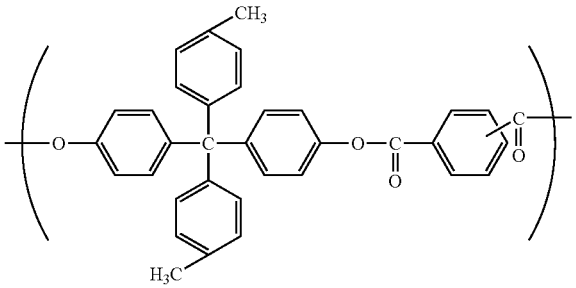
-continued
(7-13)
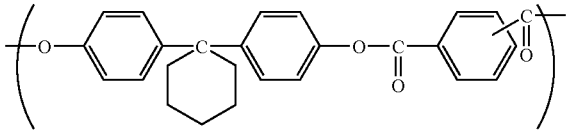
(7-14)
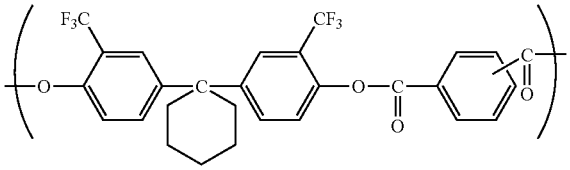
(7-15)
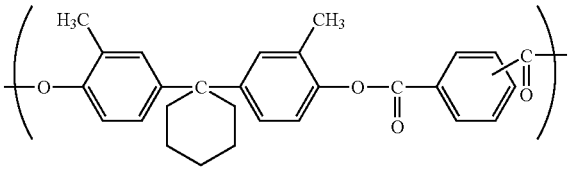
(7-16)
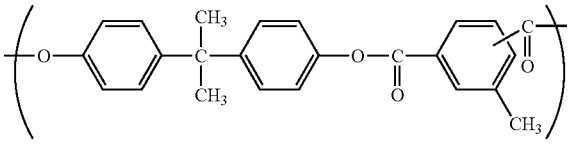
(7-17)
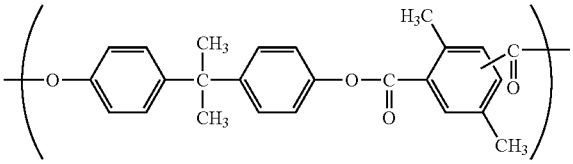
(7-18)
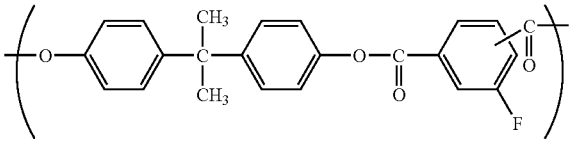
(7-19)
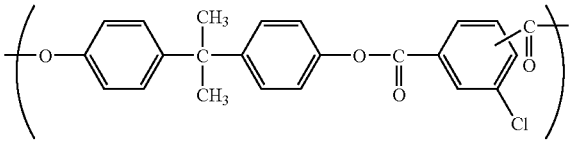
(7-20)
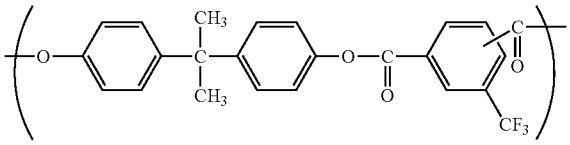

-continued (7-21)

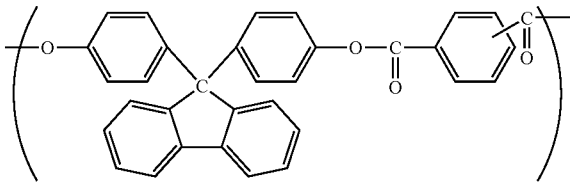

(7-22)

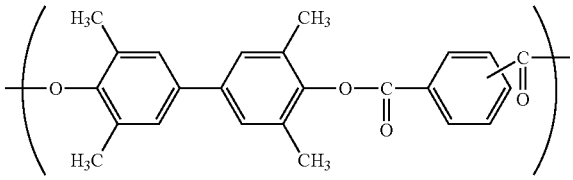

(7-23)

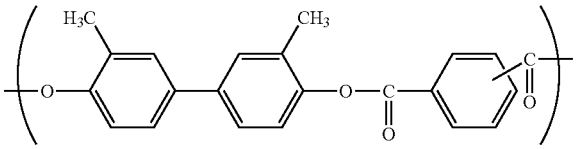

Of the above (7-1) to (7-23), (7-2), (7-3), (7-6), (7-13), (7-22), and (7-23) are preferable, and (7-3), (7-13), and (7-22) are particularly preferable.

Next, contact development means to be used in each of the electrophotographic apparatus and the process cartridge of the present invention will be described.

As described above, the contact development means to be used in each of the electrophotographic apparatus and the process cartridge of the present invention has a developer and a developer carrier for carrying a developer layer composed of at least the developer. Development is performed by: allowing the developer carrier to carry a developer layer; and bringing the developer layer into contact with the surface of the electrophotographic photoreceptor.

The developer carrier is preferably arranged to be pressed against the electrophotographic photoreceptor via a developer layer carried on the carrier. That is, the developer carrier is preferably arranged to be in contact with the electrophotographic photoreceptor when it does not carry a developer layer.

Examples of the developer carrier include; a developing roller having a semiconductive ($10^3$ to $10^9$ Ω·cm) elastic layer, and a developing roller having a conductive elastic layer ($10^2$ to $10^6$ Ω·cm) and an insulating layer (dielectric layer, $10^7$ to $10^9$ Ω·cm) placed on the conductive elastic layer. A conductive sleeve ($10^{-6}$ to $10^{-1}$ Ω·cm) having an insulating layer ($10^1$ to $10^6$ Ω·cm) on its surface (surface opposed to the electrophotographic photoreceptor), or an insulating sleeve ($10^2$ to $10^9$ Ω·cm) having a conductive layer ($10^{-6}$ to $10^1$ Ω·cm) on its surface (surface not opposed to the electrophotographic photoreceptor) can also be used as the developer carrier.

The developer carrier may be rotated in such a manner that its surface moves in the same direction as that of the surface of the electrophotographic photoreceptor or moves in the opposite direction. In the case of the same direction, the peripheral speed of the developer carrier is preferably higher than that of the electrophotographic photoreceptor. In particular, the peripheral speed of the developer carrier is preferably 120 to 300%, more preferably 140 to 250% of that of the electrophotographic photoreceptor. When a ratio of the peripheral speed of the developer carrier to the peripheral speed of the electrophotographic photoreceptor (peripheral speed ratio) becomes high, 1) the amount of a developer to be supplied to a developing portion increases, 2) the frequency of desorption of the developer (toner) with respect to an electrostatic latent image increases, 3) the developer (toner) can be scraped from a part where the developer (toner) is not needed, and 4) the developer is applied to a part where the developer is needed. The above procedure is repeated to result in an output image true to the electrostatic latent image. An excessively low peripheral speed ratio may cause a problem in terms of the quality of an output image such as poor line definition.

The developer, which may be any one of a one-component developer and a two-component developer, is preferably a one-component developer from the viewpoints of the size reduction and weight reduction of a developing device. This is because a carrier is not needed and because a mechanism for detecting the toner concentration in the developer, a mechanism for keeping the toner concentration in the developer constant, or the like is not needed. In addition, a system adopting a one-component developer for contact development, that is, so-called contact one-component development system has an advantage in that an edge effect of development can be reduced because the surface of the electrophotographic photoreceptor and a developing electrode are extremely close to each other.

Since a one-component developer contains no carrier, a system adopting a one-component developer has no action of scraping the toner remaining on the surface of an electrophotographic photoreceptor by means of a carrier, so toner fusion occurs at a frequency higher than that in a system adopting a two-component developer. Therefore, the present invention acts more effectively in a system adopting a one-component developer.

A particle of toner (toner particle) is generally obtained by externally adding an external additive to a toner matrix particle containing: a binder resin for fixing a developed image onto a transfer material such as paper; and a coloring agent for tinting. In addition, the toner matrix particle may contain a charge control agent or a low softening point material such as wax.

The content of the coloring agent in the toner particle is preferably 1 to 20 mass % with respect to the toner particle. In addition, the content of the charge control agent in the toner particle is preferably 0.1 to 10 mass % with respect to the toner particle. In addition, the content of the wax in the toner particle is preferably 5 to 30 mass % with respect to the toner particle.

Examples of the binder resin to be used in the toner particle include a styrene resin, an acrylic resin, a styrene-acrylic resin, a polyethylene resin, a polyethylene-vinyl acetate resin, a vinyl acetate resin, a polybutadiene resin, a phenol resin, a polyurethane resin, a polybutyral resin, and a polyester resin. Of those, a styrene resin, an acrylic resin, a styrene-acrylic resin, and a polyester resin are particularly preferable.

In the case where the fixing temperature of toner is reduced for shortening a first copying time (first print out time), for power savings, and for other purposes, the binder resin to be used in the toner particle preferably has a low glass transition point. For example, in the case where the fixing temperature is set in the range of 40 to 60° C., the glass transition point of the binder resin to be used in the toner particle is preferably in the range of 40 to 60° C.

However, a toner particle using a binder resin having a low glass transition point (in the range of 40 to 60° C.) is apt to cause toner fusion as compared to one having a high glass transition point. That is, the present invention acts more effectively in a system adopting a binder resin, having a low glass transition point (in the range of 40 to 60° C.), of a toner particle.

However, if the glass transition point of a binder resin to be used in a toner particle is excessively low, the storage stability of the toner deteriorates to cause a blocking phenomenon, or toner fusion into a developing device or fusion of toner with another toner occurs to bring about a reduction in flowability in some cases.

The glass transition point of a binder resin is measured by means of a differential scanning calorimeter (DSC) (specifically, DSC-7 (manufactured by PerkinElmer Japan Co., Ltd.))

Examples of a coloring agent to be used in a toner particle are given below.

Examples of a pigment-based yellow coloring agent include a condensed azo compound, an isoindolinone compound, an anthraquinone compound, an azo metal complex methine compound, and an allylamide compound. Specific examples thereof include C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 166, 168, 169, 177, 179, 180, 181, 183, 185, 191:1, 191, 192, 193, and 199. Examples of a dye-based yellow coloring agent include: C.I. solvent Yellow 33, 56, 79, 82, 93, 112, 162, and 163; and C.I. disperse Yellow 42, 64, 201, and 211.

Examples of a magenta coloring agent include a condensed azo compound, a diketopyrrolopyrrole compound, anthraquinone, a quinacridone compound, a basic dye lake compound, a naphthol compound, a benzoimidazolone compound, a thioindigo compound, and a perylene compound. Specific examples thereof include: C.I. Pigment Red 2, 3, 5, 6, 7, 23, 48:2, 48:3, 48:4, 57:1, 81:1, 122, 146, 166, 169, 177, 184, 185, 202, 206, 220, 221, and 254; and C.I. Pigment Violet 19.

Examples of a cyan coloring agent include: a copper phthalocyanine compound and a derivative thereof; an anthraquinone compound; and a basic dye lake compound. Specific examples thereof include C.I. Pigment Blue 1, 7, 15, 15:1, 15:2, 15:3, 15:4, 60, 62, and 66.

Examples of a black coloring agent include carbon black and a magnetic substance. An agent tinted with black by means of the above yellow/magenta/cyan pigments can also be used.

Examples of an external additive to be used in a toner particle include inorganic powders such as silica, alumina, and titania.

Charge control agents to be used in toner particles are classified into a negative charge control agent and a positive charge control agent. Examples of the negative charge control agent include: metal compounds of salicylic acid, an alkylsalicylic acid, a dialkylsalicylic acid, naphthoic acid, a dicarboxylic acid, and the like; polymer compounds having sulfonic acids and carboxylic acids at their side chains; boron compounds; urea compounds; silicon compounds; and calixarene. Examples of the positive charge control agent include: quaternary ammonium salts; polymer compounds having quaternary salts at their side chains; guanidine compounds; and imidazole compounds.

Examples of a wax to be used in a toner particle include: petroleum-based waxes such as a paraffin wax, a microcrystalline wax, and petrolatum, and derivatives thereof; montan waxes and derivatives thereof; hydrocarbon waxes and derivatives thereof; polyolefin waxes such as polyethylene, and derivatives thereof; natural waxes such as a carnauba wax and a candelilla wax, and derivatives thereof. Examples of the derivatives include: oxides; block copolymers with vinyl-based monomers; and graft modified products. The examples of the wax further include: higher aliphatic alcohols; aliphatic acids such as stearic acid and palmitic acid, or mixtures thereof; acid amide waxes; ester waxes; ketones; hardened castor oil and derivatives thereof; vegetable waxes; and animal waxes.

A circle equivalent number average diameter D1, an average circularity, and a circularity standard deviation of toner particles of the toner used to be in the present invention, could be measured from a circle equivalent diameter-circularity scatter gram of the toner particles, prepared by means of a flow-type particle image analyzer. The toner particles of the toner preferably have a circle equivalent number average diameter D1 (μm) of 2 to 10 μm, an average circularity of 0.920 to 0.995, and a circularity standard deviation of less than 0.040. The toner particles more preferably have a circle equivalent number average diameter D1 (μm) of 2 to 10 μm, an average circularity of 0.950 to 0.995, and a circularity standard deviation of less than 0.035. The toner particles still more preferably have a circle equivalent number average diameter D1 (μm) of 2 to 10 μm, an average circularity of 0.970 to 0.990, and a circularity standard deviation of 0.015 or more and less than 0.035.

The toner, which may be any one of: magnetic toner including toner particles containing magnetic substances; and non-magnetic toner including toner particles containing no magnetic substances, is preferably non-magnetic toner from the viewpoint of color reproduction at the time of full-color output.

To allow a developer carrier to carry a developer, for example, a developer applying member, for applying the developer to the surface of the developer carrier (here, the term "applying" also refers to supplying the developer and regulating the thickness of a developer layer), can be used. Examples of the developer applying member include one having a blade shape (a developer applying blade) and one having a roller shape (a developer applying roller). Those members may be used in combination. For example, the surface of a developer carrier may be supplied with a developer by means of a developer applying roller to form a developer layer on the surface, the thickness of the developer layer may be regulated by means of a developer applying blade. An elastic blade, a metal blade, or the like can be used as a developer applying blade.

Figure 2:
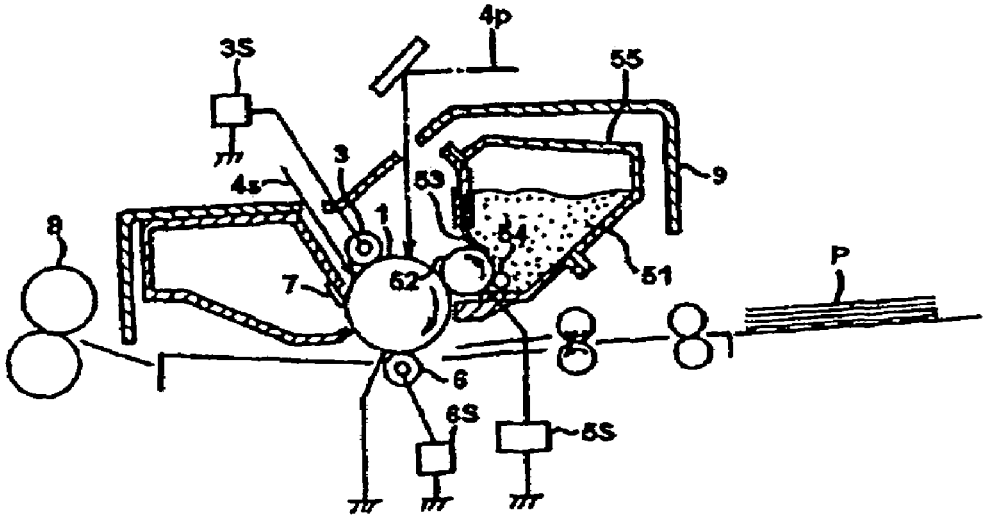
FIG. 2 is a schematic drawing showing an example of a configuration of an electrophotographic apparatus including a process cartridge of the present invention.

FIG. 2 shows an example of a schematic configuration of an electrophotographic apparatus including the process cartridge of the present invention.

In FIG. 2, reference numeral 1 denotes a cylindrical electrophotographic photoreceptor, which is rotationally driven in the direction indicated by an arrow at a predetermined peripheral speed.

The surface of the electrophotographic photoreceptor 1 to be rotationally driven is uniformly charged up to a positive or negative predetermined electric potential by charging means (primary charging means: a charging roller or the like) 3, and then receives exposure light (image exposure light) 4*p* outputted from exposing means (not shown), such as slit exposure light or laser beam scanning exposure light. Thus, electrostatic latent images each corresponding to a target image are sequentially formed on the surface of the electrophotographic photoreceptor 1. Reference symbol 3S denotes a power source for applying a charging bias to the charging means 3.

In FIG. 2, contact development means is composed of: a developer 51; a developer carrier 52; a developer applying blade 53 and a developer applying roller 54 for applying the developer 51 to the surface of the developer carrier 52; and a developer container 55 for storing the developer 51. Reference symbol 5S denotes a power source for applying a developing bias to the developer carrier 52 of the contact development means. The developer 51 is applied to the surface of the developer carrier 52 by the developer applying blade 53 and the developer applying roller 54, whereby a layer of the developer 51, that is, a developer layer is formed. The developer carrier 52 is rotationally driven in the direction indicated by an arrow at a predetermined peripheral speed.

The electrostatic latent images formed on the surface of the electrophotographic photoreceptor 1 are developed by bringing the layer of the developer 51 (developer layer) carried on the developer carrier 52 into contact with the surface of the electrophotographic photoreceptor 1, and then become developed images (toner images).

Next, the developed images (toner images) formed and carried on the surface of the electrophotographic photoreceptor 1 are sequentially transferred by virtue of a transferring bias from the transferring means 6 onto a transfer material (such as paper) P, which is taken and fed from transfer material supplying means into a space (abutment portion) between the electrophotographic photoreceptor 1 and transferring means (such as a transferring roller) 6 in synchronization with the rotation of the electrophotographic photoreceptor 1. Reference symbol 6S denotes a power source for applying a transferring bias to the transferring means.

The transfer material P onto which the developed images (toner images) have been transferred is moved from the surface of the electrophotographic photoreceptor 1 and introduced into fixing means 8 to undergo image fixation. Then, the resultant is printed out as an image formed product (print or copy) to the outside of the apparatus.

After the transfer of the developed images (toner images), the residual developer (toner), which was not transferred, on the surface of the electrophotographic photoreceptor 1 is removed by cleaning means (such as a cleaning blade) 7 to be cleansed. Furthermore, the surface is subjected to antistatic treatment by pre-exposure light 4*s* from pre-exposing means (not shown), and is then repeatedly used for image formation. Pre-exposure is not necessarily needed in the case where the charging means 3 is contact charging means using a charging roller or the like.

Two or more of the components such as the electrophotographic photoreceptor 1, the charging means 3, the contact development means, the transferring means 6, and the cleaning means 7 described above may be set up in a container and integrally connected to constitute a process cartridge, and the process cartridge may be designed to be detachably attached to the main body of an electrophotographic apparatus such as a copying machine or a laser beam printer. In FIG. 2, the electrophotographic photoreceptor 1, the charging means 3, the contact development means (including the developer 51, the developer carrier 52, the developer applying blade 53, the developer applying roller 54, and the developer container 55), and the cleaning means 7 are integrally supported to provide a process cartridge 9 that is detachably attached to the main body of the electrophotographic apparatus by means of guiding means (not shown) such as a rail of the main body.

EXAMPLES

Hereinafter, the present invention will be described in more detail by way of specific examples. However, the present invention is not limited to these examples. The term "part" in the examples means "part by mass", and the term "Mw" means "weight average molecular weight". In addition, the term "Tg" means "glass transition point". It should be noted that each of all the polyallylate resins used in the examples has a molar ratio between a terephthalic acid structure and an isophthalic acid structure (terephthalic acid structure isophthalic acid structure) of 50:50.

The diorganopolysiloxane of the present invention was synthesized in accordance with a method described in JP-A 2000-081715 or JP-A 2001-249481. More specifically, it was synthesized as described below.

Synthesis Example 1

3.23 g of a polysiloxane having repeating structural units α, β, and γ shown in Table 25 below (the respective repeating structural units are arranged at random, and each of them has a methyl group and a trimethylsilyl group as terminal groups), 20 ppm of chloroplatinic acid (5% solution in isopropyl alcohol), 18.9 g of a polystyrene derivative having a structure represented by the following formula X (n: 25 on average), and 80 g of m-xylenehexafluoride were mixed in a flask, and the mixture was gradually heated. Furthermore, a reaction was continued at 80° C. for 6 hours. Next, the pressure was reduced to 20 Torr at 140° C. to remove a solvent and a low-boiling-point component.

Analysis of the reaction product obtained as described above by means of $^{29}$Si-NMR, $^{13}$C-NMR, and FT-IR confirmed that the product was the diorganopolysiloxane corresponding to (1—1) described above.

TABLE 25

| Repeating structural unit | Structure | Average number |
|---|---|---|
| α | 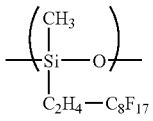 | 30 |
| β | 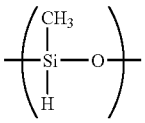 | 30 |
| γ | 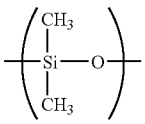 | 31 |

Formula X

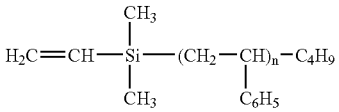

Synthesis Example 2

Synthesis was performed in the same manner as in Synthesis Example 1 except that the polystyrene derivative having the structure represented by the formula X was changed to 13.4 g of a polystyrene derivative having a structure represented by the following formula Y (n: 25 on average).

Analysis of the resultant reaction product by means of $^{29}$Si-NMR, $^{13}$C-NMR, and FT-IR confirmed that the product was the diorganopolysiloxane corresponding to (1-4) described above.

Formula Y

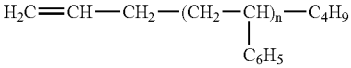

The diorganopolysiloxanes having the other structures can be synthesized in the same manner as in Synthesis Example 1 or Synthesis Example 2. The diorganopolysiloxanes corresponding to (1-17), (1-22), and (1-24) described above were synthesized for use in the following examples.

Example 1

An aluminum cylinder having a diameter of 30 mm and a length of 357 mm was provided as a support.

An application liquid for a conductive layer was prepared by using 10 parts of $SnO_2$-coated barium sulfate (conductive particles), 2 parts of titanium oxide (pigments for adjusting resistance), 6 parts of a phenol resin (binder resin), 0.001 parts of silicone oil (leveling agent), and a mixed solvent of 4 parts of methanol/16 parts of methoxypropanol.

The application liquid for a conductive layer was applied onto the support by means of dip coating and cured for 30 minutes at 145° C. (heat curing) to form a conductive layer having a thickness of 15 μm.

Next, 3 parts of N-methoxymethylated nylon and 3 parts of copolymer nylon were dissolved into a mixed solvent of 65 parts of methanol/30 parts of n-butanol to prepare an application liquid for an intermediate layer.

The application liquid for an intermediate layer was applied onto the conductive layer by means of dip coating and cured for 10 minutes at 100° C. to form an intermediate layer having a thickness of 0.5 μm.

Next, 9 parts of hydroxygallium phthalocyanine of a crystal form (charge generating substance), having strong peaks at 7.5°, 9.9°, 16.3°, 18.6°, 25.1°, and 28.3° of 2θ±0.2° (θ: Bragg angles) in X-ray diffraction with CuKα radiation, and 3 parts of a polyvinyl butyral resin (trade name: S-LEC BX-1, manufactured by Sekisui Chemical Co., Ltd.) were dispersed into 100 parts of tetrahydrofuran by using a sand mill device using glass beads each having a diameter of 1 mm. After the dispersion, 200 parts of butyl acetate were added to the resultant to prepare an application liquid for a charge generating layer.

The application liquid for a charge generating layer was applied onto the intermediate layer by means of dip coating and cured for 10 minutes at 100° C. to form a charge generating layer having a thickness of 0.3 μm.

Next, an application liquid for a charge transporting layer composed of the following materials was applied onto the charge generating layer by means of dip coating and cured for 1 hour at 130° C. to form a charge transporting layer having a thickness of 14 μm. Thus, an electrophotographic photoreceptor having the charge transporting layer as a surface layer was produced. Application liquid for a charge transporting layer

| Application liquid for a charge transporting layer | |
|---|---|
| 1) Binder resin: a polyallylate resin having the repeating structural unit represented by the formula (7-2) (Mw: 128,000) | 10 parts |
| 2) Charge transporting substance: an amine compound A having a structure represented by the following formula | 7 parts |
| 3) Charge transporting substance: an amine compound B having a structure represented by the following formula | 1 part |
| 4) Diorganopolysiloxane: the diorganopolysiloxane (1-4) (Mw: 36,000) | 0.18 part |
| 5) Solvent: monochlorobenzene/dimethoxymethane = 6/4 | 20 parts |

Amine compound A

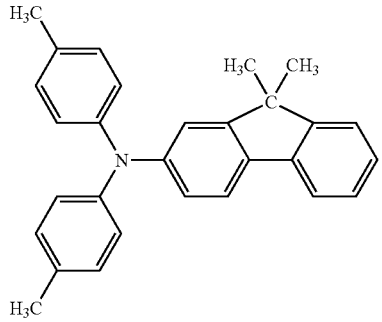

Amine compound B

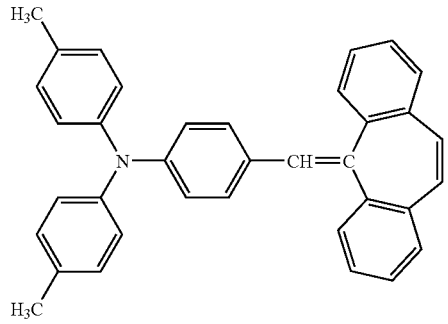

Next, the electrophotographic photoreceptor having the charge transporting layer as the surface layer was used to produce an electrophotographic apparatus, which was provided as an evaluation apparatus.

The evaluation apparatus was produced by remodeling a color laser printer "LBP-2810" manufactured by Canon Inc. (22 color prints per minute). The remodeled points in the remodeling and the specifications after the change are as follows.

1) Photoreceptor: the electrophotographic photoreceptor having the charge transporting layer as the surface layer 2) Developer carrier: a developing roller having a conductive elastic layer formed by using a silicone resin and an insulating layer formed by using a urethane resin on the conductive elastic layer ($10^5$ Ω·cm)

The developing roller is brought into abutment with the electrophotographic photoreceptor at an intruding quantity of 80 μm.

3) Developer carrier driving means: means for rotating the developer carrier in such a manner that the surface of the developer carrier moves in the same direction as that of the surface of the electrophotographic photoreceptor, on the abutment portion; the peripheral speed of the developer carrier is 180% of that of the electrophotographic photoreceptor 4) Developer: a non-magnetic one-component developer using non-magnetic toner Black toner: one composed of toner particles obtained by externally adding silica particles (external additive) to toner matrix particles produced by using: a styrene-acrylic copolymer as a binder resin (Tg: 58° C., styrene: acrylic (NBMA) =55:45 (copolymerization ratio), Mw: 400,000); carbon black as a coloring agent (formulated in such a manner that its content is 5 mass % with respect to the toner particles); a monoazo iron complex as a charge control agent (formulated in such a manner that its content is 1 mass % with respect to the toner particles); and an ester wax as a wax (melting point: 62° C., formulated in such a manner that its content is 8 mass % with respect to the toner particles) (circle equivalent number average diameter D1 of the toner particles: 5.5 μm, average circularity of the toner particles: 0.981, circularity standard deviation: 0.021), which is provided as toner A Yellow toner, magenta toner, and cyan toner: not used First, by using the above remodeled device of the color laser printer "LBP-2810" manufactured by Canon Inc., a pattern with an image ratio of 6% was continuously printed on 50 sheets of A4 paper under a 30° C./80% RH environment. Next, a pattern with an image ratio of 2% was continuously printed on 50 sheets of A4 paper. After that, a solid white pattern was printed on 1 sheet of A4 paper (a print A). The image formation up to this stage was performed only by an image forming portion for black (black station).

The reflectance ($r_A$) of the print A and the reflectance ($r_0$) of unprinted A4 paper were measured, and the difference ($r_A$−$r_0$) was defined as an initial fogging density.

Next, 8,000 sheets of A4 paper each having a pattern with an image ratio of 6% were outputted in a one-sheet intermittent mode. Next, a pattern with an image ratio of 2% was continuously printed on 50 sheets of A4 paper. After that, a solid white pattern was printed on one sheet of A4 paper (a print B). The image formation up to this stage was also performed only by the image forming portion for black (black station).

The reflectance ($r_B$) of the print B was measured, and the difference ($r_B$−$r_0$) between $r_B$ and the reflectance ($r_0$) of unprinted A4 paper was defined as an endurance fogging density.

The reflectance was measured by means of a reflection densitometer "RD918" manufactured by Macbeth.

After that, a maximum scratch depth (Rmax) on the surface of the electrophotographic photoreceptor was measured. The maximum scratch depth (Rmax) was measured in conformance with JIS-B0601-1982 and by means of a Surfcom 480A manufactured by Tokyo Seimitsu Co., Ltd.

Furthermore, the surface of the electrophotograhic photoreceptor was evaluated for the degree of toner fusion. Evaluation criteria are as follows. Table 26 shows the measurements or the results of the evaluation.

A: the number of fusions in 10 $cm^2$ is 0

B: the number of fusions in 10 $cm^2$ is 1 to 10

C: the number of fusions in 10 $cm^2$ is 11 to 50

D: the number of fusions in 10 $cm^2$ is 51 or more

Example 2

An electrophotographic photoreceptor and an evaluation apparatus were produced in the same manner as in Example 1 except that the amount of the diorganopolysiloxane (1-4) used in the application liquid for a charge transporting layer was changed from 0.18 part to 0.9 part, and then evaluation was performed. Table 26 shows the results.

Example 3

An electrophotographic photoreceptor and an evaluation apparatus were produced in the same manner as in Example 2 except that the diorganopolysiloxane (1-4) in the application liquid for a charge transporting layer was changed to the diorganopolysiloxane (1-17) (Mw: 45,000), and then evaluation was performed. Table 26 shows the results.

Example 4

An electrophotographic photoreceptor and an evaluation apparatus were produced in the same manner as in Example 2 except that the diorganopolysiloxane (1-4) in the application liquid for a charge transporting layer was changed to the diorganopolysiloxane (1-22) (Mw: 29,000), and then evaluation was performed. Table 26 shows the results.

Example 5

An electrophotographic photoreceptor and an evaluation apparatus were produced in the same manner as in Example 2 except that the diorganopolysiloxane (1-4) in the application liquid for a charge transporting layer was changed to the diorganopolysiloxane (1-24) (Mw: 32,000), and then evaluation was performed. Table 26 shows the results.

Example 6

An electrophotographic photoreceptor and an evaluation apparatus were produced in the same manner as in Example 1 except that the polyallylate resin having the repeating structural unit represented by the formula (7-2) in the application liquid for a charge transporting layer was changed to a polycarbonate resin having the repeating structural unit represented by the formula (6-3) (Mw: 106,000), and then evaluation was performed. Table 26 shows the results.

Example 7

An electrophotographic photoreceptor and an evaluation apparatus were produced in the same manner as in Example 6 except that the amount of the diorganopolysiloxane (1-4) used in the application liquid for a charge transporting layer was changed from 0.18 part to 0.9 part, and then evaluation was performed. Table 26 shows the results.

Example 8

An electrophotographic photoreceptor was produced in the same manner as in Example 1, and an evaluation apparatus was produced in the same manner as in Example 1 except that the black toner (toner A) used in the evaluation apparatus of Example 1 was changed to the following black toner, and then evaluation was performed. Table 26 shows the results.

Black toner: one composed of toner particles obtained by externally adding silica particles (external additive) to toner matrix particles produced by using: a styrene-acrylic copolymer as a binder resin (Tg: 45° C., styrene: acrylic (NBMA)=30/70 (copolymerization ratio), Mw: 320,000); carbon black as a coloring agent (formulated in such a manner that its content is 6 mass % with respect to the toner particles); a monoazo iron complex as a charge control agent (formulated in such a manner that its content is 1 mass % with respect to the toner particles); and an ester wax as a wax (melting point: 60° C., formulated in such a manner that its content is 8 mass % with respect to the toner particles) (circle equivalent number average diameter D1 of the toner particles: 6.8 μm, average circularity of the toner particles: 0.977, circularity standard deviation: 0.030), which is provided as toner B Example 9

An electrophotographic photoreceptor was produced in the same manner as in Example 2, and an evaluation apparatus was produced in the same manner as in Example 2 except that the toner A was changed to the toner B, and then evaluation was performed. Table 26 shows the results.

Example 10

An electrophotographic photoreceptor was produced in the same manner as in Example 3, and an evaluation apparatus was produced in the same manner as in Example 3 except that the toner A was changed to the toner B, and then evaluation was performed. Table 26 shows the results.

Example 11

An electrophotographic photoreceptor was produced in the same manner as in Example 4, and an evaluation apparatus was produced in the same manner as in Example 4 except that the toner A was changed to the toner B, and then evaluation was performed. Table 26 shows the results.

Example 12

An electrophotographic photoreceptor was produced in the same manner as in Example 5, and an evaluation apparatus was produced in the same manner as in Example 5 except that the toner A was changed to the toner B, and then evaluation was performed. Table 26 shows the results.

Example 13

An electrophotographic photoreceptor was produced in the same manner as in Example 6, and an evaluation apparatus was produced in the same manner as in Example 6 except that the toner A was changed to the toner B, and then evaluation was performed. Table 26 shows the results.

Example 14

An electrophotographic photoreceptor was produced in the same manner as in Example 7, and an evaluation apparatus was produced in the same manner as in Example 7 except that the toner A was changed to the toner B, and then evaluation was performed. Table 26 shows the results.

TABLE 26

| | Electrophotographic photoreceptor (surface layer) | | | Evaluation apparatus | | Results of evaluation | | | |
|---|---|---|---|---|---|---|---|---|---|
| | Repeating structural unit of biner resin [binder resin Mw] | Structure of releasing agent [releasing agent Mw] | Content *1 [mass %] | Development system | Toner | Initial fogging density | Fogging density after endurance | Rmax *2 [μm] | Toner fusion |
| Example1 | (7-2) | (1-4) | 0.99 | Contact | Toner | 0.2 | 0.2 | 1.5 | A |
| Example2 | [128000] | [360000] | 4.76 | development | A | 0.1 | 0.3 | 1.2 | A |
| Example3 | | (1-17) [45000] | | system | | 0.3 | 0.3 | 1.1 | A |
| Example4 | | (1-22) [29000] | | | | 0.1 | 0.2 | 1.3 | A |
| Example5 | | (1-24) [32000] | | | | 0.1 | 0.3 | 1.3 | A |
| Example6 | (6-3) | (1-4) | 0.99 | | | 0.3 | 0.4 | 1.1 | A |
| Example7 | [106000] | [360000] | 4.76 | | | 0.2 | 0.4 | 1.4 | A |
| Example8 | (7-2) | (1-4) | 0.99 | | Toner | 0.3 | 0.4 | 1.5 | A |
| Example9 | [128000] | [360000] | 4.76 | | B | 0.3 | 0.5 | 0.9 | A |
| Example10 | | (1-17) [45000] | | | | 0.4 | 0.6 | 1.5 | A |
| Example11 | | (1-22) [29000] | | | | 0.1 | 0.3 | 1.1 | A |
| Example12 | | (1-24) [32000] | | | | 0.2 | 0.4 | 1.4 | A |
| Example13 | (6-3) | (1-4) | 0.99 | | | 0.3 | 0.3 | 1.6 | A |
| Example14 | [106000] | [360000] | 4.76 | | | 0.4 | 0.5 | 1.8 | A |

*1 and 2 are as follows

*1 Content: content of releasing agent in surface layer (mass percentage with respect to total mass of surface layer)

*2 Rmax: maximum scratch depth on surface of electrophotographic photoreceptor

Comparative Example 1

An electrophotographic photoreceptor and an evaluation apparatus were produced in the same manner as in Example 1 except that no diorganopolysiloxane was added to the application liquid for a charge transporting layer, and then evaluation was performed. Table 27 shows the results.

Comparative Example 2

An electrophotographic photoreceptor and an evaluation apparatus were produced in the same manner as in Example 1 except that the diorganopolysiloxane (1-4) in the application liquid for a charge transporting layer was changed to dimethyl silicone oil (trade name: KF96, manufactured by Shin-Etsu Silicones), and then evaluation was performed. Table 27 shows the results.

Comparative Example 3

An electrophotographic photoreceptor and an evaluation apparatus were produced in the same manner as in Example 1 except that the diorganopolysiloxane (1-4) in the application liquid for a charge transporting layer was changed to graft silicone oil (trade name: GS101, manufactured by To a Gosei Co., Ltd.), and then evaluation was performed. Table 27 shows the results.

Comparative Example 4

An electrophotographic photoreceptor was produced in the same manner as in Comparative Example 1 except that 10 parts of the polyallylate resin having the repeating structural unit represented by the formula (7-2) in the application liquid for a charge transporting layer were changed to a mixture of 9 parts of the polycarbonate resin having the repeating structural unit represented by the formula (6-3) (Mw: 106,000) and 1 part of a polycarbonate resin having the repeating structural unit represented by the formula (6-3) and a repeating structural unit represented by the following formula (a) at a ratio of 9:1 (molar ratio) (Mw: 86,000), and then evaluation was performed. Table 27 shows the results. Each of two "O—$C_6H_4$—C" bonds in the following formula (a) has a molar ratio between an ortho bond and a para bond (ortho bond: para bond) of 50:50.

(a)

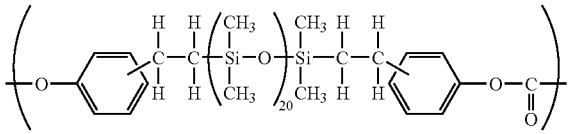

Comparative Example 5

An electrophotographic photoreceptor and an evaluation apparatus were produced in the same manner as in Example 2 except that the diorganopolysiloxane (1-4) in the application liquid for a charge transporting layer was changed to ethylene tetrafluoride resin particles (one kind of fluorine atom-containing resin particles), and then evaluation was performed. Table 27 shows the results.

Comparative Example 6

An electrophotographic photoreceptor and an evaluation apparatus were produced in the same manner as in Comparative Example 5 except that the amount of the ethylene tetrafluoride resin particles used in the application liquid for a charge transporting layer was changed from 0.9 part to 4.5 parts, and then evaluation was performed. Table 27 shows the results.

Reference Example 1

An electrophotographic photoreceptor was produced in the same manner as in Comparative Example 5, and an evaluation apparatus was produced in the same manner as in Comparative Example 5 except that: the developer carrier and developer of the evaluation apparatus were changed as follows; and the development system was changed to a non-contact development system, and then evaluation was performed. Table 27 shows the results.

Developer carrier: a developing sleeve having a fixed magnet in it

Developer: a two-component developer prepared by mixing a magnetic carrier and the non-magnetic toner used in Example 1 (magnetic carrier: non-magnetic toner=9:1 (mass ratio))

Reference Example 2

An electrophotographic photoreceptor was produced in the same manner as in Comparative Example 6, and an evaluation apparatus was produced in the same manner as in Comparative Example 6 except that: the developer carrier and developer of the evaluation apparatus were changed as follows; and the development system was changed to a non-contact development system, and then evaluation was performed. Table 27 shows the results.

Developer carrier: a developing sleeve having a fixed magnet in it

Developer: a two-component developer prepared by mixing a magnetic carrier and the non-magnetic toner used in Example 1 (magnetic carrier: non-magnetic toner=9:1 (mass ratio))

TABLE 27

| | Electrophotographic photoreceptor (surface layer) | | | Evaluation apparatus | | Results of evaluation | | | |
|---|---|---|---|---|---|---|---|---|---|
| | Repeating structural unit of biner resin [binder resin Mw] | Structure of releasing agent [releasing agent Mw] | Content *1 [mass %] | Development system | Toner | Initial fogging density | Fogging density after endurance | Rmax *2 [μm] | Toner fusion |
| Comparative Example1 | (7-2) | No addition | 0 | Contact | Toner | 0.8 | 1.0 | 4.4 | D |
| Comparative Example2 | [128000] | KF96 | 0.99 | development | A | 0.7 | 0.9 | 3.9 | C |
| Comparative Example3 | | GS101 | 0.99 | system | | 0.6 | 0.9 | 4.1 | C |
| Comparative Example4 | (6-3) [106000] (6-3):(a) = 9:1 [86000] | No addition | 0 | | | 0.4 | 0.8 | 2.8 | D |

TABLE 27-continued

| | Electrophotographic photoreceptor (surface layer) | | | Evaluation apparatus | | Results of evaluation | | | |
|---|---|---|---|---|---|---|---|---|---|
| | Repeating structural unit of biner resin [binder resin Mw] | Structure of releasing agent [releasing agent Mw] | Content *1 [mass %] | Development system | Toner | Initial fogging density | Fogging density after endurance | Rmax *2 [μm] | Toner fusion |
| Comparative Example5 | (7-2) | PTFE | 4.76 | | | 0.6 | 0.8 | 2.9 | B |
| Comparative Example6 | [128000] | | 20 | | | 0.8 | 0.8 | 3.5 | B |
| Reference Example1 | (7-2) | | 4.76 | Non-contact development system | Toner C | 0.2 | 0.3 | 1.7 | B |
| Reference Example2 | [128000] | | 20 | | | 0.1 | 0.2 | 1.3 | B |

*1 and 2 are as follows
*1 Content: content of releasing agent in surface layer (mass percentage with respect to total mass of surface layer)
*2 Rmax: maximum scratch depth on surface of electrophotographic photoreceptor

The invention claimed is:

1. An electrophotographic apparatus, including:

1) an electrophotographic photoreceptor having a support and a photosensitive layer placed on the support;

2) charging means for charging a surface of the electrophotographic photoreceptor;

3) exposing means for irradiating the surface of the electrophotographic photoreceptor charged by the charging means with exposure light to form an electrostatic latent image on the surface of the electrophotographic photoreceptor;

4) contact development means, that has a developer and a developer carrier for carrying a developer layer composed of at least the developer, for forming a developed image on the surface of the electrophotographic photoreceptor by bringing the developer layer carried on the developer carrier into contact with the surface of the electrophotographic photoreceptor to develop the electrostatic latent image; and 5) transferring means for transferring the developed image on the surface of the electrophotographic photoreceptor formed by the contact development means onto a transfer material, wherein a surface layer of the electrophotographic photoreceptor contains a diorganopolysiloxane wherein 0.01 to 20% of the mass of the surface layer is composed of said diorganopolysiloxane, wherein said diorganopolysiloxane has a repeating structural unit α represented by the following formula (11) and a repeating structural unit β represented by the following formula (12), and wherein the surface layer does not contain fluorine-atom containing resin particles:

(11)

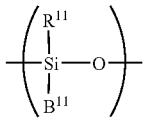

(12)

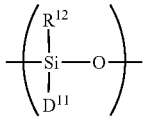

wherein in the formulae (11) and (12):

$R^{11}$ and $R^{12}$ each independently represent a substituted or unsubstituted and monovalent hydrocarbon group;

$B^{11}$ represents a monovalent organic group having a perfluoroalkyl group; and $D^{11}$ represents a monovalent organic group having a substituted or unsubstituted polystyrene chain with a polymerization degree of 3 or more, a monovalent organic group having a substituted or unsubstituted alkyleneoxy group, a monovalent organic group having a substituted or unsubstituted siloxane chain, or a monovalent organic group having 12 or more carbon atoms.

2. An electrophotographic apparatus according to claim 1, wherein the developer comprises a one-component developer.

3. An electrophotographic apparatus according to claim 1 or 2, wherein the developer contains toner containing a binder resin having a glass transition point in a range of 40 to 60° C.

4. An electrophotographic apparatus according to claim 1 or 2, further comprising developer carrier driving means for rotationally driving the developer carrier at a peripheral speed higher than a peripheral speed of the electrophotographic photoreceptor.

5. A process cartridge, including:

1) an electrophotographic photoreceptor having a support and a photosensitive layer placed on the support; and 2) contact development means, that has a developer and a developer carrier for carrying a developer layer composed of at least the developer, for forming a developed image on a surface of the electrophotographic photoreceptor by bringing the developer layer carried on the developer carrier into contact with the surface of the electrophotographic photoreceptor to develop an electrostatic latent image formed on the surface of the electrophotographic photoreceptor, the process cartridge integrally supporting the electrophotographic photoreceptor and the contact development means, the process cartridge being detachably attached to a main body of an electrophotographic apparatus, wherein a surface layer of the electrophotographic photoreceptor contains a diorganopolysiloxane wherein 0.01 to 20% of the mass of the surface layer is composed of said diorganopolysiloxane, wherein said diorganopolysiloxane has a repeating structural unit α represented by the following formula (11) and a repeating structural unit β represented by the following formula (12), and wherein the surface layer of the electrophotographic photoreceptor does not contain fluorine-atom containing resin particles:

(11)

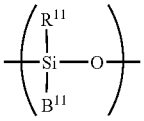

(12)

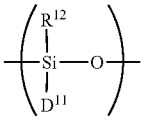

wherein in the formulae (11) and (12):

$R^{11}$ and $R^{12}$ each independently represent a substituted or unsubstituted and monovalent hydrocarbon group;

$B^{11}$ represents a monovalent organic group having a perfluoroalkyl group; and $D^{11}$ represents a monovalent organic group having a substituted or unsubstituted polystyrene chain with a polymerization degree of 3 or more, a monovalent organic group having a substituted or unsubstituted alkyleneoxy group, a monovalent organic group having a substituted or unsubstituted siloxane chain, or a monovalent organic group having 12 or more carbon atoms.

6. A process cartridge according to claim 5, wherein the developer comprises a one-component developer.

7. A process cartridge according to claim 5 or 6, wherein the developer contains toner containing a binder resin having a glass transition point in a range of 40 to 60° C.

* * * * *

UNITED STATES PATENT AND TRADEMARK OFFICE

CERTIFICATE OF CORRECTION

PATENT NO. : 7,160,659 B2
APPLICATION NO. : 11/109756
DATED : January 9, 2007
INVENTOR(S) : Hirotoshi Uesugi et al.

It is certified that error appears in the above-identified patent and that said Letters Patent is hereby corrected as shown below:

COLUMN 1
Line 42, “design Examples” should read --design. ¶Examples--.

COLUMN 2
Line 42, “that” should read --that:--.
Line 45, “unit a” should read --unit α--.

COLUMN 3
Line 22, “that” should read --that:--.
Line 25, “unit a” should read --unit α--.

COLUMN 7
Line 15, “units a” should read --units α--.
Line 40, “units a” should read --units α--.
Line 43, “multiple $B^{11}$” should read --multiple $B^{11}$’s--.

COLUMN 8
Line 34, “(1—1)” should read --(1-1)--.

COLUMN 9
Table 1-2 continued, line 24, “48” should read --46--.

COLUMN 10
Table 4-5 continued, line 32, “48” should read --46--.

COLUMN 12
Table 9 continued, line 15, “n=50” should read --m=50--.

COLUMN 20
Line 39, “(1—1)” should read --(1-1)-- (both occurrences).

COLUMN 22
Line 47, “squalelium” should read --squarylium--.

COLUMN 23
Line 19, “atliter,” should read --attriter,--.

COLUMN 33
Line 17, “Ltd.))” should read --Ltd.)).--.

UNITED STATES PATENT AND TRADEMARK OFFICE

CERTIFICATE OF CORRECTION

PATENT NO. : 7,160,659 B2
APPLICATION NO. : 11/109756
DATED : January 9, 2007
INVENTOR(S) : Hirotoshi Uesugi et al.

It is certified that error appears in the above-identified patent and that said Letters Patent is hereby corrected as shown below:

COLUMN 34
Line 14, “used to be” should read --to be used--.
Line 16, “scatter gram” should read --scattergram--.

COLUMN 36
Line 16, “structure isophthalic” should read --structure: isophthalic--.
Line 42, “(1—1)” should read --(1-1)--.

COLUMN 38
Line 8, “Application liquid for a charge” should be deleted.
Line 9, “transporting layer” should be deleted.

COLUMN 42
Table 26, “biner” should read --binder--.

COLUMN 43
Line 16, “To” should read --Toa--.
Line 17, “a” should be deleted.

COLUMN 44
Table 27, “biner” should read --binder--.

COLUMN 45
Table 27 continued, “biner” should read --binder--.

Signed and Sealed this

Tenth Day of February, 2009

JOHN DOLL
*Acting Director of the United States Patent and Trademark Office*